US006464853B1

(12) United States Patent
Iwasaki et al.

(10) Patent No.: US 6,464,853 B1
(45) Date of Patent: Oct. 15, 2002

(54) METHOD OF PRODUCING STRUCTURE HAVING NARROW PORES BY ANODIZING

(75) Inventors: Tatsuya Iwasaki, Machida; Tohru Den, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/472,125

(22) Filed: Dec. 23, 1999

(30) Foreign Application Priority Data

Jan. 6, 1999 (JP) ..... 11-001239
Jan. 6, 1999 (JP) ..... 11-001268
Dec. 13, 1999 (JP) ..... 11-353094

(51) Int. Cl.[7] ..... C25D 11/04

(52) U.S. Cl. ..... 205/118; 205/121; 205/124; 205/324

(58) Field of Search ..... 205/106–108, 205/118, 121, 122, 124, 135, 136, 324

(56) References Cited

U.S. PATENT DOCUMENTS 5,741,435 A * 4/1998 Beetz, Jr. et al. ..... 252/62.55
6,139,713 A * 10/2000 Masuda et al. ..... 205/206
6,214,738 B1 * 4/2001 Aiba et al. ..... 438/707
6,231,744 B1 * 5/2001 Ying et al. ..... 205/324

OTHER PUBLICATIONS

F. A. Lowenheim, Electroplating, McGraw–Hill Book Co., New York, pp. 452–455, 1978. Month of publication not available.*

Matsuda, et al., Kotaibutsuri (Solid State Physics) 31, 493 (1996).

Furneaux, et al., "The Formation of Controlled–porosity Membranes from Anodically Oxidized Aluminium", *Letters to Nature*, vol. 337, Jan. 1989; pp. 147–149.

Masuda, et al., "Fabrication of a One–dimensional Micro-hole Array by Anodic Oxidation of Aluminum", *American Institute of Physics; Appl. Phys. Lett*, 63(23), Dec. 1993; pp. 3155–3157.

* cited by examiner

*Primary Examiner*—Donald R. Valentine
*Assistant Examiner*—William T. Leader
(74) *Attorney, Agent, or Firm*—Fitzpatrick, Cella, Harper & Scinto

(57) ABSTRACT

A method of producing a structure having narrow pores includes a first step of bringing pore-guiding members into contact with upper and lower surfaces of a member comprising aluminum as a principal ingredient and a second step of anodizing the member comprising aluminum as the principal ingredient to form narrow pores. The pore-guiding members contain the same material as a principal ingredient. The second step includes preferably a step of transforming the member comprising aluminum as the principal ingredient into a porous body comprising alumina having narrow pores oriented substantially parallel to the interfaces between the pore-guiding members and the member comprising aluminum as the principal ingredient.

50 Claims, 18 Drawing Sheets

ANODIZING APPARATUS

METHOD OF PRODUCING STRUCTURE HAVING NARROW PORES BY ANODIZING

BACKGROUND OF THE INVENTION

1. Field of the Invention

The present invention relates to nano-structures provided with narrow pores, which can be used in various fields, for example, as functional materials and structural materials for electronic devices, optical devices, micro devices, and the like.

2. Description of the Related Art

With respect to thin films, narrow wires, and small dots made of metals and semiconductors, unique electrical, optical, and chemical properties may be demonstrated when movement of electrons is confined to a size less than a specific length. In view of this, there has been a growing interest in materials having fine structures with sizes of less than several hundreds of nanometers (nm) (i.e., nano-structures) as functional materials.

Nano-structures are produced, for example, by semiconductor processing techniques, such as micro pattern writing techniques including photolithography, electron-beam lithography, X-ray lithography, and the like.

In addition to the production methods described above, attempts have been made to produce new nano-structures based on naturally formed regular structures, namely, structures formed in a self-ordering manner. Since there is a possibility of producing finer, more special structures in comparison with those produced by conventional methods, much research has been conducted.

One self-ordering method is anodization in which nano-structures having nano-size narrow pores can be formed easily and controllably. For example, anodized alumina is known, which is produced by anodizing aluminum or an alloy thereof in an acidic bath.

When an Al plate is anodized in an acidic electrolytic bath, a porous oxide film is formed (for example, refer to R. C. Furneaux, W. R. Rigby, and A. P. Davidson, NATURE, Vol. 337, p.147 (1989)). As shown in FIG. 10, the porous oxide film is characterized by a geometric structure in which extremely fine cylindrical narrow pores (nano-holes) 14 having diameters of several nanometers to several hundred nanometers are arrayed in parallel within distances of several nanometers to several hundred nanometers. The cylindrical narrow pores 14 have high aspect ratios and highly uniform cross-sectional diameters.

It is also possible to control the structure of the film to a certain extent by the selection of the anodizing conditions. For example, it is possible to control, to a certain extent, the distance between narrow pores by the anodizing voltage, the depth of the pores by time, and the pore diameter by a pore-widening treatment.

Furthermore, as an example of controlling the array of narrow pores, it has been reported by Masuda et al. that ordered nano-holes having a honeycomb array are formed by anodizing under suitable anodizing conditions (Masuda, Kotaibutsuri (Solid State Physics) 31, 493 (1996)).

Another example has been reported by Masuda et al., in which an Al film sandwiched between insulators is anodized in the film surface direction with the aim of arraying narrow pores in a matrix (Appl. Phys. Lett. 63, p.3155 (1993)).

Various applications have been attempted in view of the peculiar geometric structure of anodized alumina as described above. As described in detail by Masuda, for example, anodized films are used as coatings by taking advantage of their wear resistance and dielectric properties, and detached films are used as filters. Moreover, by using techniques for filling a metal or a semiconductor into nano-holes and replication techniques of nano-holes, application to various fields has been attempted, such as coloring, magnetic recording media, electroluminescent devices, electrochromic devices, optical devices, solar cells, and gas sensors. Application to a number of other fields is also expected, for example, to quantum well devices such as quantum wires and MIM devices, and molecular sensors which use nano-holes as chemical reaction fields (Masuda, Kotaibutsuri (Solid State Physics) 31, 493 (1996)).

SUMMARY OF THE INVENTION

It is an object of the present invention to provide a nano-structure in which the structure is controlled in a more sophisticated manner.

That is, it is an object of the present invention to control the arrays, distances, positions, directions, etc. of narrow pores in structures having narrow pores formed by anodizing.

It is another object of the present invention to provide novel nanometer-scale structures and devices by controlling the arrays, distances, positions, directions, etc. of narrow pores.

The objects described above are achieved by the following production methods in accordance with the present invention.

In one aspect, a method of producing a structure having narrow pores, in accordance with the present invention, includes a first step of bringing pore-guiding members into contact with upper and lower surfaces of a member comprising aluminum as a principal ingredient, and a second step of anodizing the member comprising aluminum as the principal ingredient to form narrow pores. The pore-guiding members contain the same material as a principal ingredient.

In another aspect, a method of producing a structure having narrow pores, in accordance with the present invention, includes a first step of disposing a pore-guiding member and a member comprising aluminum as a principal ingredient having a predetermined pattern on a substrate, the pore-guiding member being in contact with the periphery of the pattern of the member comprising aluminum as the principal ingredient, and a second step of anodizing the member comprising aluminum as the principal ingredient to form narrow pores.

In another aspect, a method of producing a structure having narrow pores, in accordance with the present invention, includes a first step of covering the periphery of a rod-like member comprising aluminum as a principal ingredient with a pore-guiding member, and a second step of anodizing the member comprising aluminum as the principal ingredient to form narrow pores.

In another aspect, a method of producing a structure having narrow pores includes a first step of covering the periphery of a rod-like first pore-guiding member with a member comprising aluminum as a principal ingredient and further covering the member comprising aluminum as the principal ingredient with a second pore-guiding member, and a second step of anodizing the member comprising aluminum as the principal ingredient to form narrow pores.

In another aspect, a method of producing a structure having narrow pores, in accordance with the present invention, includes a first step of bringing a first pore-guiding member and a second pore-guiding member into contact with upper and lower surfaces of a member comprising aluminum as a principal ingredient, and a second step of anodizing the member comprising aluminum as the principal ingredient to form narrow pores. At least one of the first pore-guiding member and the second pore-guiding member is electrically conductive.

As described above, in the first aspect of the present invention, "the pore-guiding members contain the same material as a principal ingredient", which means that, if each pore-guiding member contains an element such as a metal as a principal ingredient, the pore-guiding members contain the same element, or if each pore-guiding member contains a compound as a principal ingredient, the pore-guiding members contain the same compound. Basically, it is acceptable in the present invention if the pore-guiding members have the same chemical properties (such as stability to a solution used in anodization) and the same electrical properties (such as an electric field generated during anodization).

Additionally, "a principal ingredient" in the present invention refers to an ingredient having the highest content among elements and/or compounds contained in a given member.

In accordance with the methods of the present invention, narrow pores of anodized alumina can be formed in the direction parallel to the interface between the pore-guiding member and aluminum (resultant anodized alumina). Furthermore, by appropriately bringing the pore-guiding member into contact with the periphery of the aluminum film having a predetermined pattern on the substrate, the anodized alumina having narrow pores in which the direction is controlled in parallel to the interface between the pore-guiding member and aluminum can be formed by patterning.

In the present invention, by using an electrically conductive material as the pore-guiding member, in the initial stage of forming narrow pores, control of the structure can be increased, and a porous body having excellent uniformity in the shape (narrow-pore diameters, etc.) from the outermost surface to the bottom can be produced.

Furthermore, by appropriately selecting the thickness of the pore-guiding member, the thickness of the member comprising aluminum as the principal ingredient, anodizing voltages, etc., the pore array pitch, the pore diameter, etc. may be controlled.

Furthermore, by disposing a pore-terminating member on the member comprising aluminum as the principal ingredient, narrow pores may be formed highly uniformly at a predetermined length.

That is, in accordance with the methods of the present invention, the position, length, pitch, direction, pattern, etc. of narrow pores having nanometer size diameters can be controlled.

Furthermore, with respect to structures which are produced by embedding a functional material, such as a metal or a semiconductor, into the narrow pores formed by the methods described above, there are possibilities of application to new electronic devices.

The present invention enables anodized alumina to be used for various fields, such as quantum wires, MIM devices, molecular sensors, coloring, magnetic recording media, electroluminescent devices, electrochromic devices, optical devices such as photonic bands, electron emitters, solar cells, gas sensors, coatings having wear resistance and dielectric properties, and filters, and the present invention contributes to the significant expansion of applications for anodized alumina.

Further objects, features and advantages of the present invention will become apparent from the following description of the preferred embodiments with reference to the attached drawings.

BRIEF DESCRIPTION OF THE DRAWINGS

FIGS. 6A to 6C are schematic sectional views showing an example of the production process of a nano-structure according to the present invention, in which FIG. 6A illustrates a state in which a base is formed, FIG. 6B illustrates a state in which the base is anodized to form anodized alumina, and FIG. 6C illustrates a state in which pore diameters are increased by pore-widening treatment;

FIGS. 7A to 7C are schematic sectional views showing an example of the production process of a nano-structure according to the present invention, in which FIG. 7A illustrates a state in which a base is formed, FIG. 7B illustrates a state in which the base is anodized to form anodized alumina, and FIG. 7C illustrates a state in which Ni is filled into a narrow pore;

FIGS. 8A to 8C are schematic diagrams showing the arrays of narrow pores when patterned aluminum is anodized, in which FIG. 8A illustrates a case in which patterned aluminum is anodized, FIG. 8B illustrates a case in which patterning is performed while the surface of aluminum is covered with a patterned mask, and FIG. 8C illustrates a case in which pore-guiding members are disposed on the sides of aluminum;

FIGS. 11A and 11B are schematic diagrams of a basic structure in accordance with example 1 of the present invention, in which FIG. 11A illustrates a base and FIG. 11B illustrates a state in which a porous body is formed;

FIGS. 15A to 15C are schematic sectional views which show an example of the production process of a nano-structure according to the present invention, in which FIG. 15A illustrates a state in which a base is formed, FIG. 15B illustrates a state in which the base is anodized to form anodized alumina, and FIG. 15C illustrates a state in which a metal is filled into a narrow pore;

DESCRIPTION OF THE PREFERRED EMBODIMENTS

Due to problems such as low yields and high equipment costs associated with the production of nanometer-scale structures by the semiconductor processing techniques described in Related Art, a simple method of producing nano-structures with good reproducibility has been desired.

In view of this, self-regulating methods, in particular aluminum anodizing methods, are desirable because nanometer-scale structures can be produced relatively easily and controllably, and large areas can be formed. However, due to existing limits in controlling the porous structure, it has not yet been possible to make full use of these structures.

In the ordered nano-holes described above, distances between formable narrow pores are limited.

Figure 8A:
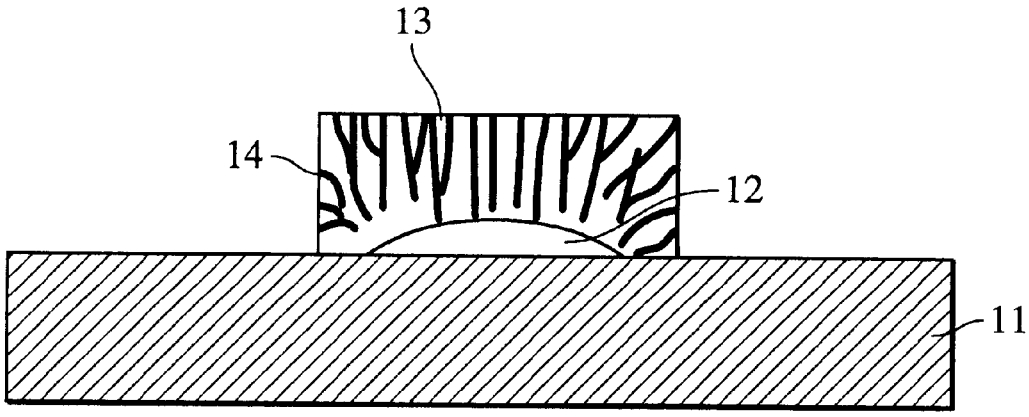
Figure 8B:
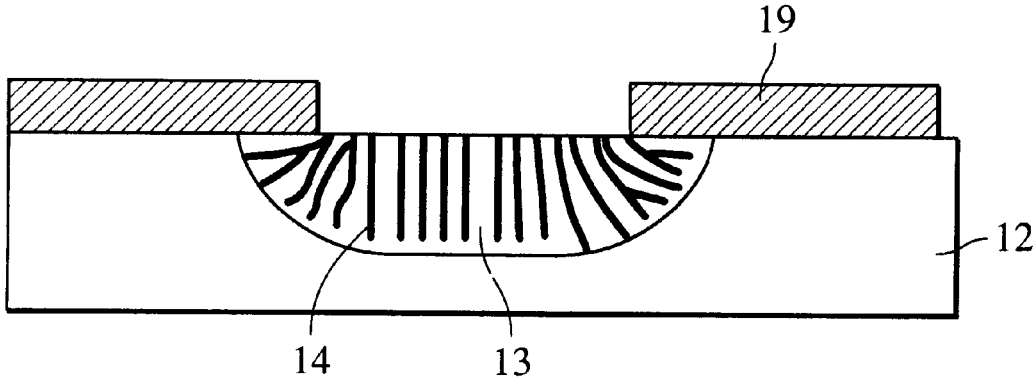
Figure 9A:
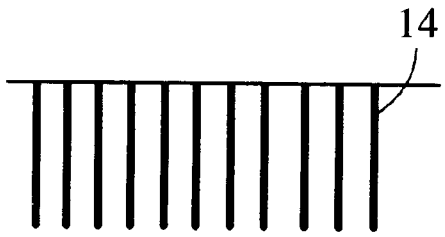
FIGS. 9A to 9D are schematic diagrams which show the relationship between the shapes of aluminum and the directions of narrow pores.
Figure 9B:
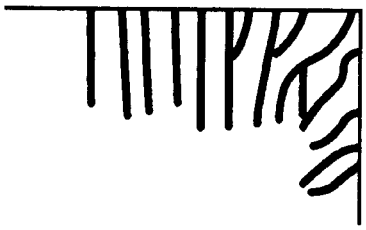
Figure 9C:
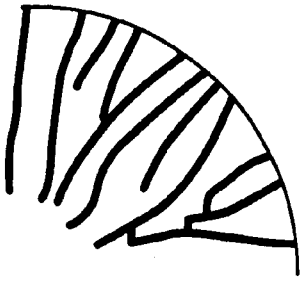
Figure 9D:
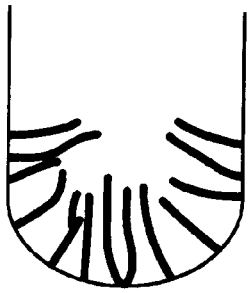

Further, the direction of the narrow pores is greatly influenced by the shape of the aluminum used as a base metal. For example, although narrow pores 14 advance perpendicular to the planar surface of an aluminum plate as shown in FIG. 9A, the curved or edged surface of aluminum makes the array and direction of narrow pores disordered as narrow pores advance as shown in FIGS. 9B, 9C, and 9D. In particular, in view of use of anodized alumina for various devices, patterning on a substrate is desirable. However, as shown in FIG. 8A, when a patterned Al film is anodized to produce anodized alumina 13, the narrow pore array becomes disordered at the ends of the patterned Al film. As shown in FIG. 8B, when patterning is performed while the aluminum surface is covered with a mask 19, the narrow pore array also becomes disordered.

Examples of structures produced by the methods in accordance with the present invention will be described with reference to the drawings.

In FIGS. 1A and 1B through FIGS. 13A, 13B, 13C, and 13D, numeral 11 represents a substrate, numeral 12 represents aluminum, numeral 13 represents anodized alumina (a porous body), numeral 14 represents a narrow pore (nano-hole) formed in a portion of anodized alumina, and numeral 16 represents a pore-guiding member.

Figure 1A:
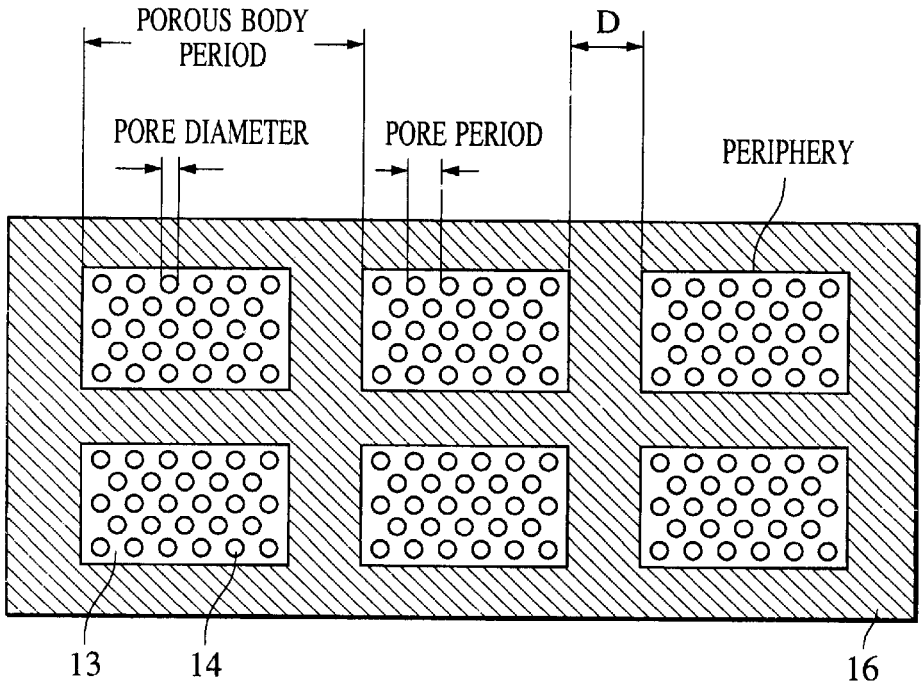
FIGS. 1A and 1B are a plan view and a sectional view, respectively, which schematically show nano-structures (regional structures) according to the present invention.
Figure 10:
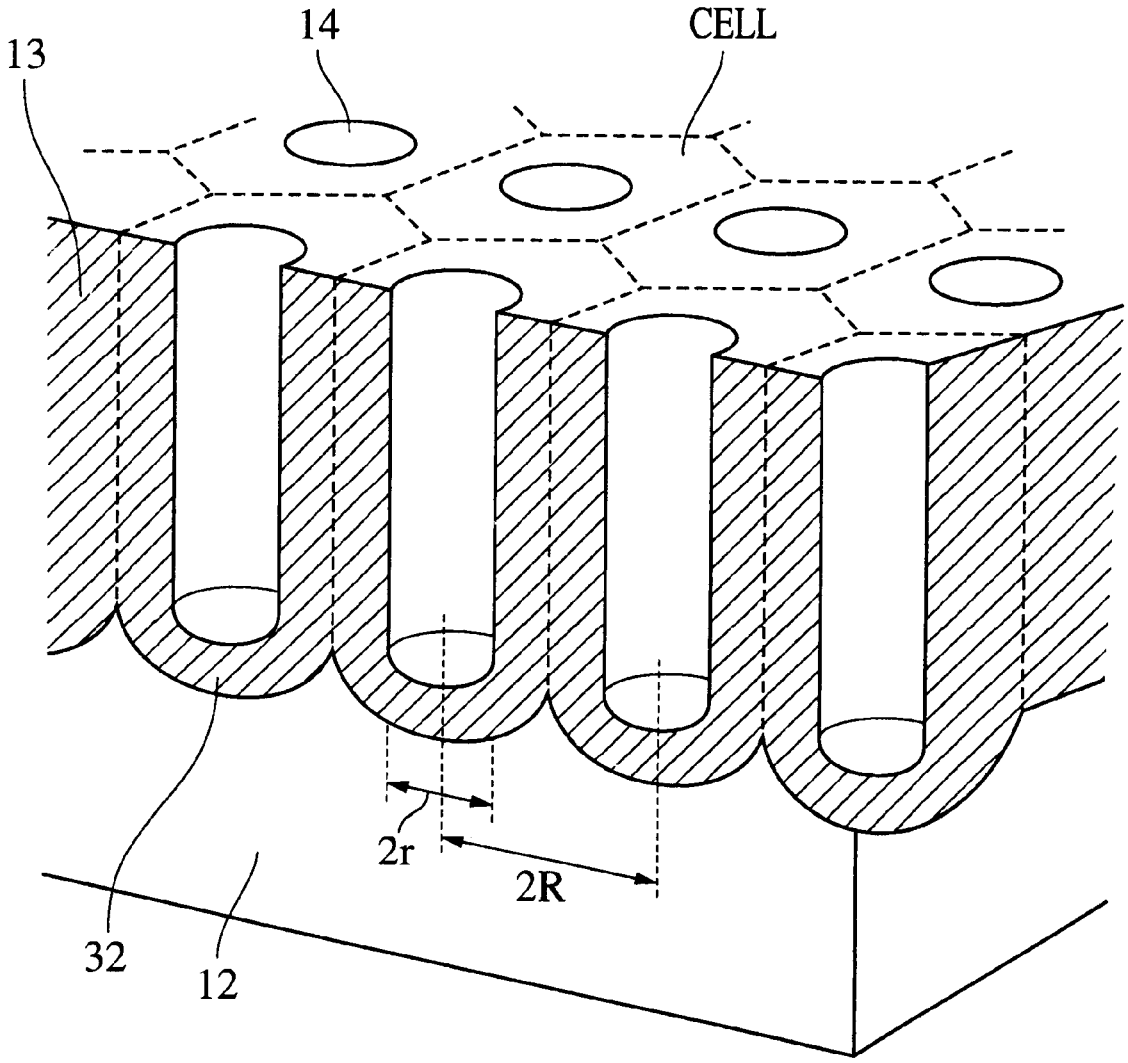
FIG. 10 is a schematic perspective view of anodized alumina.

First, anodized alumina 13 in the present invention will be described. The anodized alumina 13 contains Al and O as principal ingredients, and has many cylindrical narrow pores (nano-holes) 14, which are arrayed substantially in parallel and substantially at equal distances, as shown in FIG. 10. The individual narrow pores tend to be arrayed in a triangular lattice shape as shown in FIG. 1A. A diameter 2*r* of the narrow pore is several nanometers to several hundreds of nanometers, a pore distance 2R between neighboring narrow pores (cell size) is several nanometers to several hundreds of nanometers, and the depth of the pores is 10 nm or more. The distances, diameters, and depths of narrow pores can be controlled to a certain extent by processing conditions such as the concentration and temperature of an electrolytic solution used for anodizing, the method of applying voltage in anodizing, the voltage, time, and the conditions for subsequent pore-widening treatment. The thickness of the anodized alumina 13 and the depth (length) of narrow pores can be controlled by selecting the anodizing time, the thickness of Al, etc.

The structures in the present invention include 1) a regional structure, in which a region of a porous body is delimited by surrounding the periphery of the porous body with a pore-guiding member, 2) a layered structure, in which layers of a porous body and a pore-guiding member are laminated, and 3) a needle structure, in which a porous body and a pore-guiding member are arranged in the center or around the periphery of a needle or rod.

1) Regional Structure

Figure 1B:
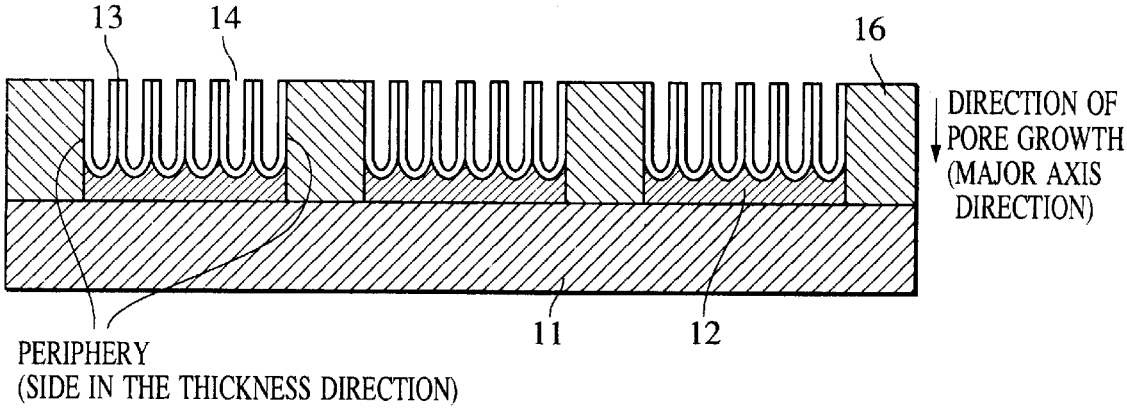

A structure shown in FIGS. 1A and 1B is an example of the regional structure. In FIGS. 1A and 1B, numeral 11 represents a substrate, numeral 12 represents aluminum, numeral 13 represents a porous body (anodized alumina), numeral 14 represents a narrow pore (nano-hole), and numeral 16 represents a pore-guiding member.

Such a structure can be produced, for example, as shown in FIGS. 1A and 1B, by anodizing a base in which a pore-guiding member is arranged so as to surround the periphery (the side in the thickness direction) of a member comprising aluminum as a principal ingredient (Al film). By employing such a structure as the base, as shown in FIG. 1B, the direction of narrow-pore growth (major axis direction) can be set in the direction substantially parallel to the interfaces between pore-guiding members and the porous bodies (i.e., in the direction of the thickness of the Al film).

Figure 8C:
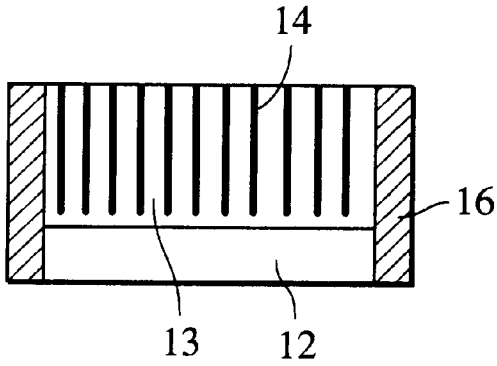

If a patterned member comprising aluminum as a principal ingredient is simply anodized, as described above with reference to FIG. 8A, the array of narrow pores 14 becomes disordered at the ends (periphery or sides) of the member comprising aluminum as the principal ingredient. However, in accordance with the present invention, as shown in FIG. 8C, by disposing a pore-guiding member 16 at the side (periphery) of aluminum patterned on a substrate, the direction of narrow pores (the major axis direction) can be set substantially parallel to the interface between the pore-guiding member and the member comprising aluminum as the principal ingredient, which becomes alumina, in the overall region, namely, in the direction substantially perpendicular to the surface of the substrate (principal surface).

With respect to the regional structure, by embedding a functional material, such as a metal, a semiconductor, or an organic material, into narrow pores, application of the resulting porous structures to quantum wires, MIM devices, molecular sensors, coloring, magnetic recording media, electroluminescent devices, electrochromic devices, electron emitters, etc. is expected.

2) Layered Structure

Layered structures include, for example, structures shown in FIGS. 2A to 2F, in which pore-guiding members 16 and porous bodies (anodized alumina 13) are laminated on the surfaces of substrates 11 (principal surfaces).

In an example of the method of producing such a structure, first, on the surface (principal surface) of a substrate 11, a member comprising aluminum as a principal ingredient (Al film) and a pore-guiding member 16 are alternately laminated, and thus the surface of the member comprising aluminum as the principal ingredient is covered with the pore-guiding member 16. The cross section of the laminate (the surface substantially perpendicular to the lamination direction, or the thickness direction) is then anodized. By the anodization, narrow pores 14 can be formed substantially parallel to the surface of the substrate 11 and/or the interface between the pore-guiding member and the member comprising aluminum as the principal ingredient (resultant alumina), namely, substantially parallel to the surface (principal surface) of the substrate 11.

That is, with the periphery (surface) of the patterned member comprising aluminum as the principal ingredient being covered by the pore-guiding member 16, by anodizing the surface that is not covered with the pore-guiding member 16, i.e., the exposed surface of the member comprising aluminum as the principal ingredient, narrow pores grow in the direction substantially parallel to the interface between the pore-guiding member 16 and the member comprising aluminum as the principal ingredient (resultant alumina). Therefore, the narrow pores 14 can be arrayed along the external shape of the member comprising aluminum as the principal ingredient (resultant alumina) or substantially parallel to the periphery thereof.

In this structure, pore-guiding members 16 are brought into contact with upper and lower surfaces of a member comprising aluminum as a principal ingredient (Al film). The pore-guiding members 16 disposed on the upper and lower surfaces are preferably of the same material. The reason for this is that, if pore-guiding members 16 of different materials are disposed on the upper and lower surfaces, the distribution of electric fields generated on the surfaces of the members comprising aluminum as the principal ingredient during anodizing may become asymmetrical, depending on the types of materials. Consequently, the shapes of narrow pores 14 to be formed may be asymmetrical in the thickness direction. Therefore, when a structure having narrow pores 14 in this structure is produced, for example, preferably, a first pore-guiding member is disposed on a substrate, an Al film is disposed thereon, and a second pore-guiding member made of the same material as the first pore-guiding member is further disposed on the Al film. The material for the substrate may be the same as the material for the pore-guiding member. In such a case, preferably, a patterned Al film is laminated on the surface of a substrate, and a pore-guiding member made of the same material as the substrate is further laminated on the Al film.

In accordance with this structure, the anodized surface region of a member comprising aluminum as a principal ingredient can be controlled by the thickness of the member comprising aluminum as the principal ingredient. Therefore, the surface region having sizes of several tens of nanometers to several hundreds of nanometers corresponding to the pore distance of anodized alumina can be produced relatively easily by controlling the thickness of the aluminum, which is advantageous.

Since the direction of pore growth can also be set along the pattern of a film comprising aluminum as a principal ingredient (resultant alumina film) formed on a substrate, various types of narrow pore structures can be produced.

The distances, diameters, and depths (lengths) of narrow pores can be controlled to a certain extent by processing conditions such as the concentration and temperature of an electrolytic solution used for anodizing, a method of applying voltage in anodizing, the voltage, time, and the conditions for subsequent pore-widening treatment.

Figure 2A:
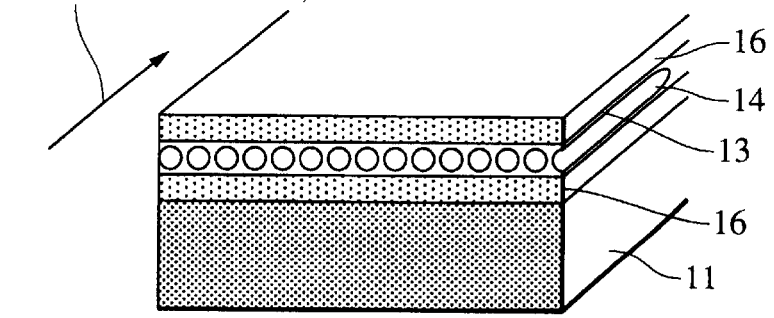
FIGS. 2A, 2D, and 2F are perspective views
Figure 2B:
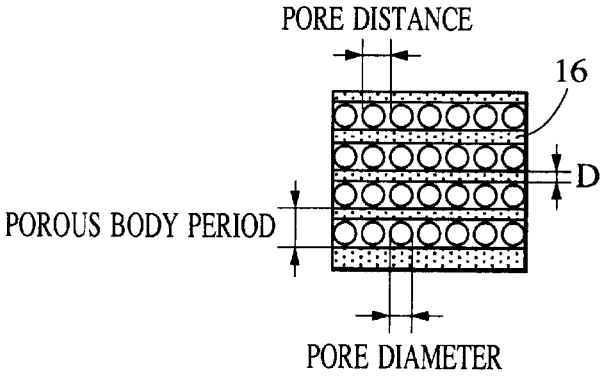
FIGS. 2B, 2C, and 2E are sectional views, respectively, which schematically show nano-structures (layered structures) according to the present invention.
Figure 2C:
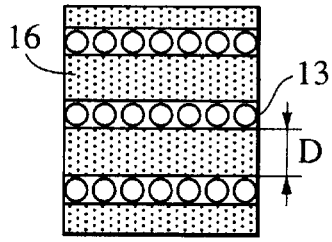

The thicknesses of the Al film and the pore-guiding member can be appropriately set at between several nanometers and several micrometers. The distance between porous bodies can be established by the thickness of the pore-guiding member. That is, as shown in FIGS. 2B and 2C, the long periodic structure of porous bodies can be controlled by the thickness of the pore-guiding member, and the short periodic structure of narrow pores (distance between neighboring narrow pores) can be controlled by the anodizing conditions. By using such controls, optical properties of the structure can be controlled.

Figure 2D:
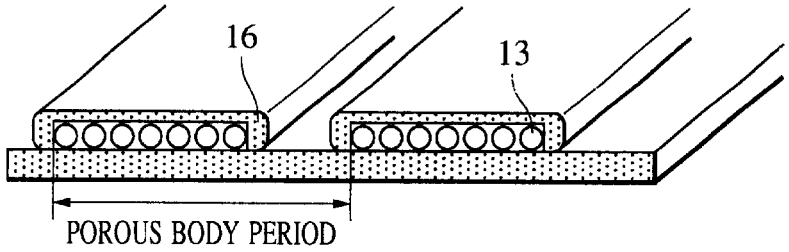
Figure 2E:
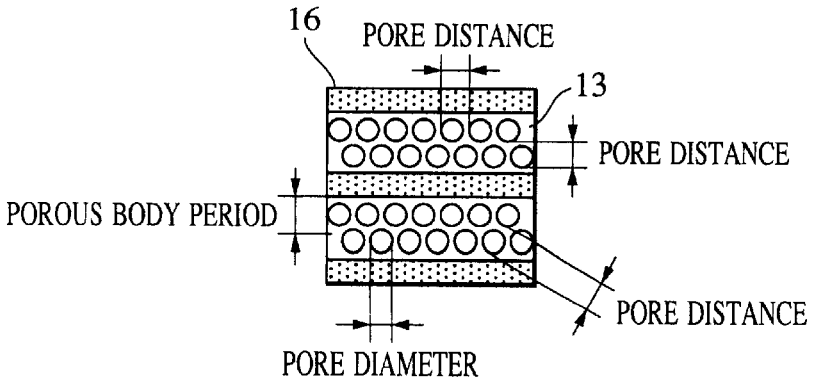
Figure 2F:
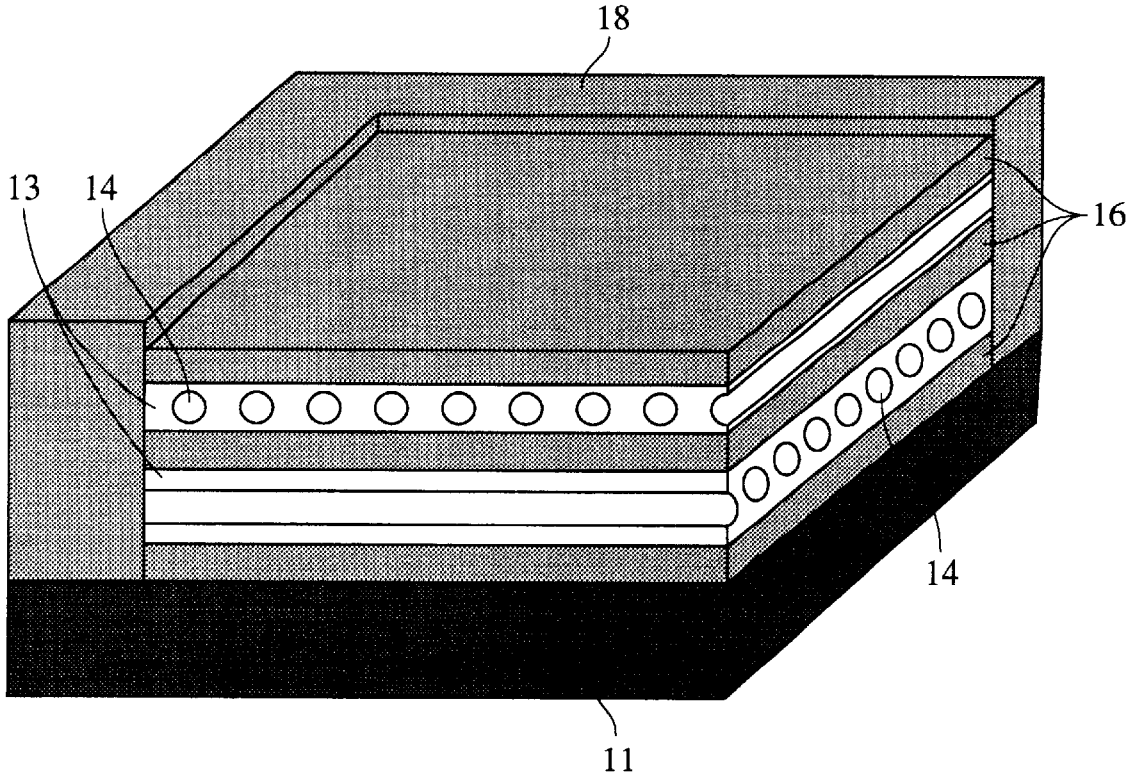

By setting the thickness of the Al film and the anodizing voltage, the number of rows of narrow pores and the distance between neighboring narrow pores also can be controlled. That is, since the cell size of anodized alumina can be determined by the voltage, one sets the thickness of the Al film to correspond to the desired cell size. For example, in the case of anodizing at 40 V, a cell size of approximately 100 nm is obtained. Thus, by setting the thickness of the Al film at 100 nm, narrow pores can be arrayed substantially in a row as shown in FIG. 2A, and by setting the thickness of the Al film at approximately 180 nm, a porous body having narrow pores arrayed in two rows can be obtained as shown in FIG. 2E. In this way, by appropriately setting the anodizing voltage and the thickness of the Al film, the array of narrow pores can be more ordered. Additionally, as shown in FIGS. 2D and 2F, by patterning Al, a plurality of porous bodies may be arrayed.

With respect to the layered structure, by embedding a functional material, such as a metal, a semiconductor, or an organic material, into the narrow pores, application of these structures for quantum wires, MIM devices, optical devices, etc. is expected.

3) Needle Structure (Rod Structure)

Figure 3A:
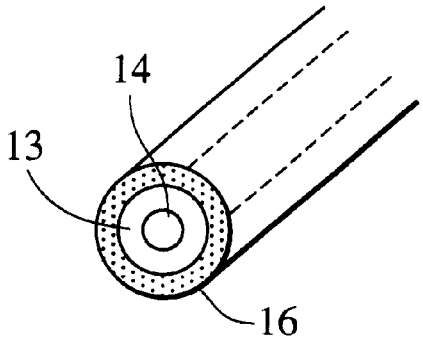
FIGS. 3A, 3B, and 3C are schematic perspective views of nano-structures (needle structures) according to the present invention.
Figure 3B:
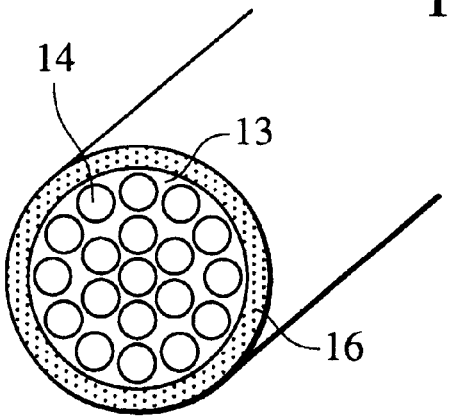
Figure 3C:
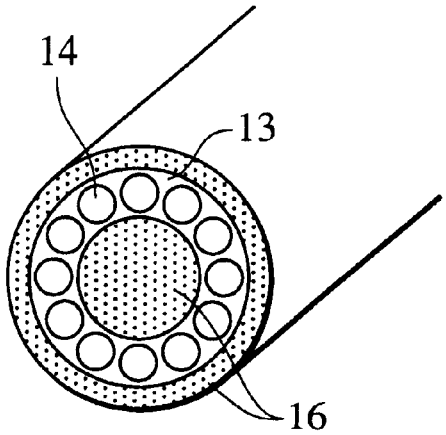

Needle structures include, for example, structures shown in FIGS. 3A to 3C, in which the cross section of a columnar base, such as a rod base or a needle base, is anodized, and narrow pores grow in the major axis direction of the needle (rod) base. In structures shown in FIGS. 3A and 3B, as bases, aluminum needles (rods) are covered with pore-guiding members 16 in the peripheries in the lengthwise direction (sides). In a structure shown in FIG. 3C, as a base, a needle (rod) of a pore-guiding member 16 is covered with a member comprising aluminum as a principal ingredient in the periphery in the lengthwise direction, and the member comprising aluminum as the principal ingredient is further covered with a pore-guiding member 16 in the periphery in the lengthwise direction. A plurality of such rod-like bases may be tied up in a bundle and solidified by an epoxy or the like to form a base.

With respect to such a structure, by embedding a functional material, such as a metal, a semiconductor, or an organic material, into the narrow pores, use of the resulting structure in quantum wires, electrochemical micro electrodes, probes for tunneling microscopes, molecular sensors, electron emitters, etc. is expected.

Figure 13A:
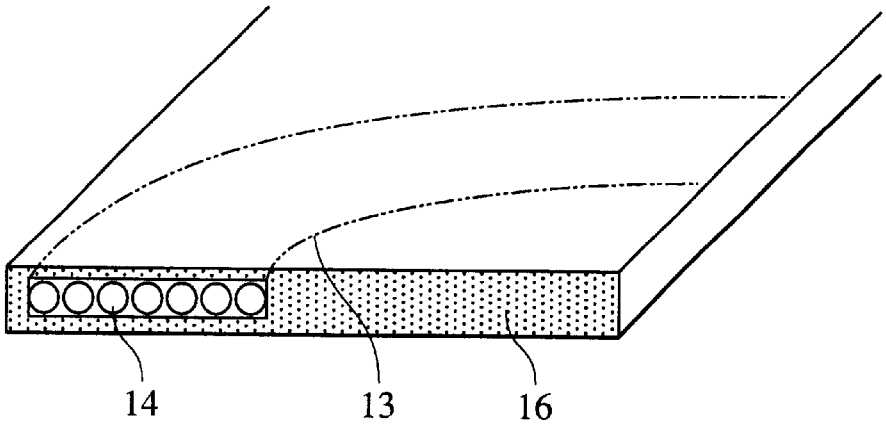
FIGS. 13A to 13D are schematic diagrams which show nano-structures having nonlinear narrow pores according to the present invention.
Figure 13B:
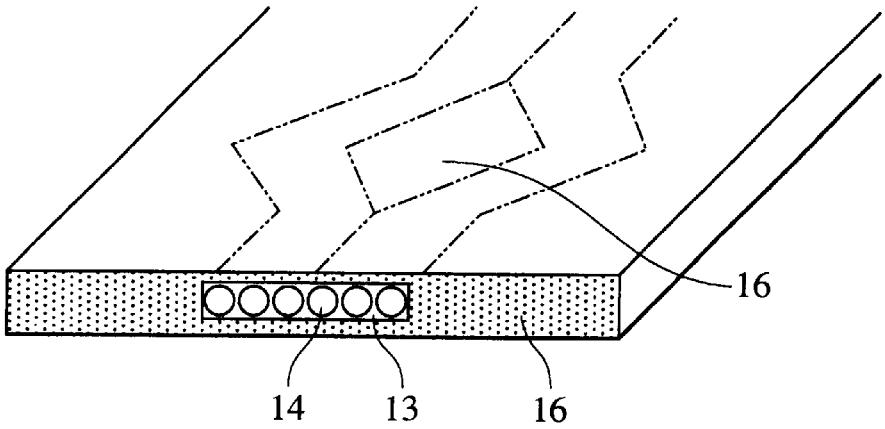
Figure 13C:
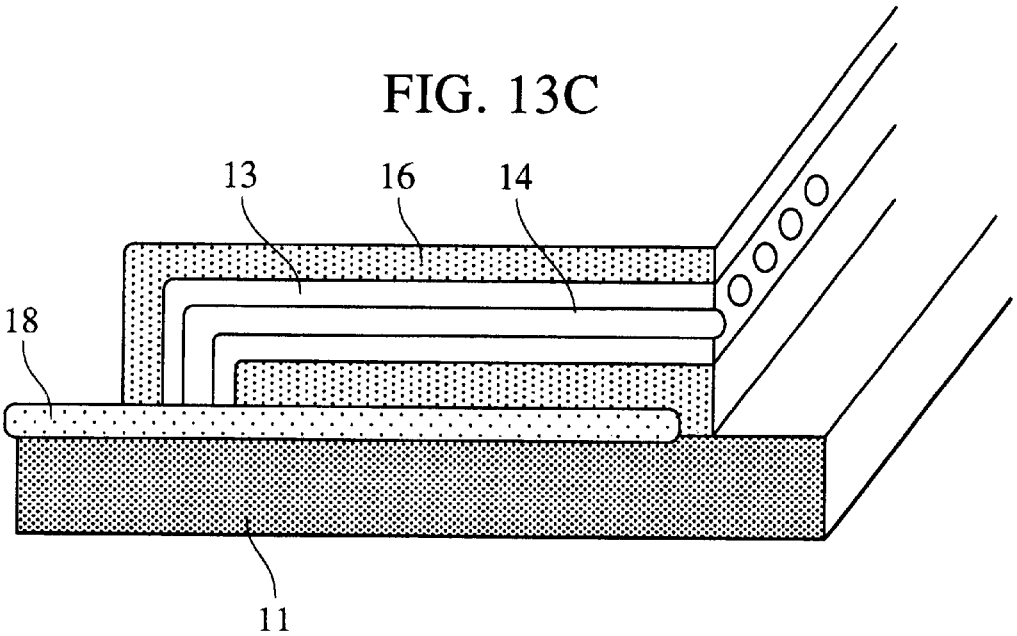
Figure 13D:
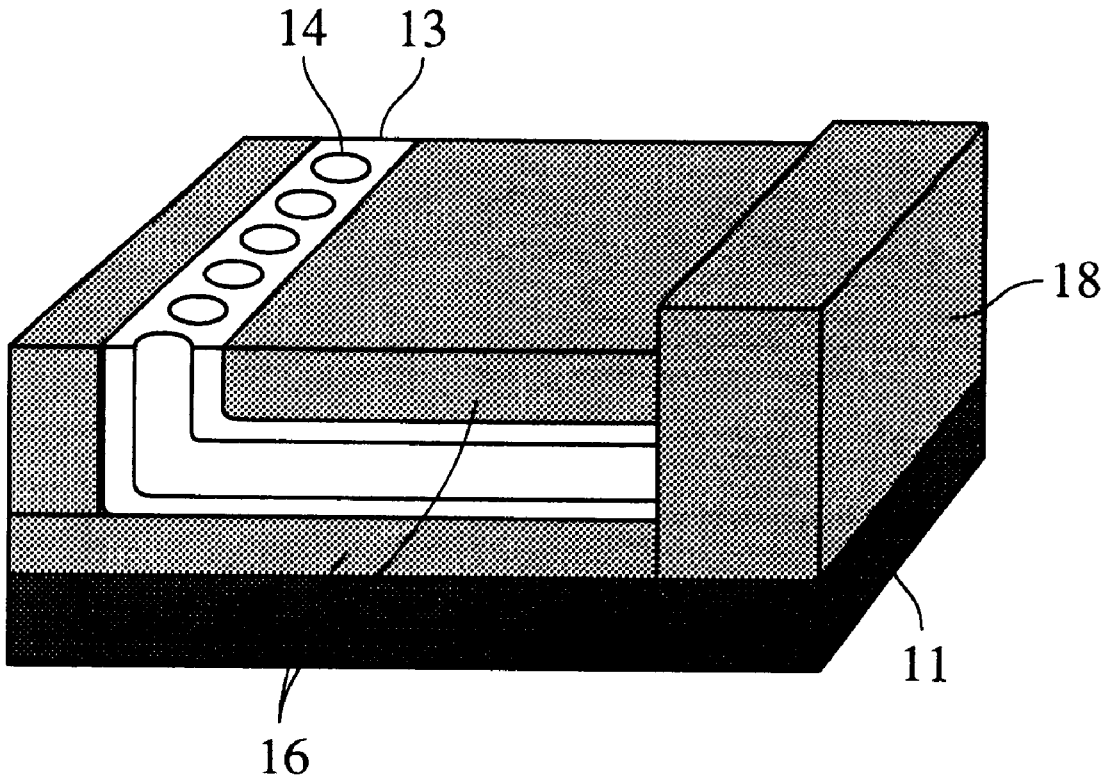

Furthermore, since narrow pores grow along a pore-guiding member that is disposed in contact with aluminum, by arranging a pore-guiding member in a predetermined shape, the direction of narrow-pore growth (major axis direction of narrow pores) can be controlled in a predetermined shape, such as a curved shape or a rectangular shape. Specifically, for example, as shown in FIGS. 13A to 13D, by covering the surfaces of patterned Al films (members comprising aluminum as a principal ingredient) with pore-guiding members, the directions of narrow pores are controlled to produce structures in which the directions of narrow pores are nonlinear (curved) as shown in FIGS. 13A, 13C, and 13D, or so that the narrow pores are branched off or merged as shown in FIG. 13B.

The material for the pore-guiding member is not specifically limited, and an insulator, a semiconductor, or a conductor may be used.

Insulators which can be preferably used in the present invention include electrochemically stable inorganic materials such as $SiO_2$, $Al_2O_3$, SiN, and AlN, and organic polymers such as epoxies and polyimides.

However, when an insulator is used as the pore-guiding member, at the beginning of anodization, the potential distribution may be disturbed in the aluminum surface because the electric potential of the surface of the insulator is unstable, and thus instability may be generated in the initial formation of the narrow pores.

Consequently, in order to make the pore growth more stable and more controllable, a conductive material is preferably used as the material for the pore-guiding member. By using a pore-guiding member having conductivity, during the anodizing process, a more stable potential can be maintained in the sides of narrow pores through the pore-guiding member. Therefore, narrow pores can be advanced in the desired direction, for example, with satisfactory linearity. Thus, narrow pores can be arrayed with good reproducibility along the interface between the pore-guiding member and the member comprising aluminum as a principal ingredient (resultant alumina).

However, if a noble metal, an element of the iron group, or the like is used as the pore-guiding member, during anodization, a large electric current flows because of electrolysis of an electrolytic solution and dissolution of a pore-terminating member, resulting in damage to the structure.

Consequently, as the conductive pore-guiding member that can be more preferably used in the present invention, a conductive material containing an element having an electronegativity of 1.5 to 1.8 as a principal ingredient is used, and in particular, a metal mainly composed of Ti, Zr, Hf, Nb, Ta, Mo, or W is used. More particularly, in view of oxide film forming-speed and insulating properties of the oxide film, a conductive material containing Ti, Nb, or Mo as a principal ingredient is desirable.

As the semiconductive pore-guiding member, by using an n-type semiconductor such as Si or GaAs, pores can be formed with good reproducibility.

Furthermore, if a conductive material is used as the pore-guiding member, it is possible to obtain a structure in which a metal and a porous body are hybridized, and thus the range of choices for materials is extended.

Figure 4:
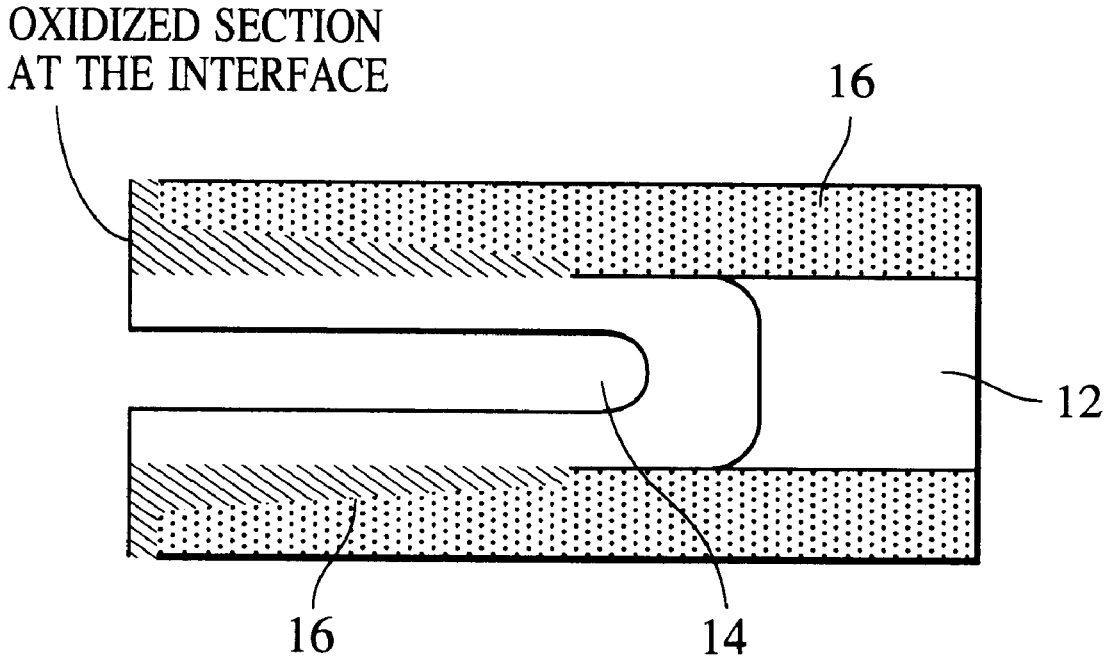
FIG. 4 is a schematic sectional view which shows the interfaces between a porous body and pore-guiding members.

When a conductive material is used as the pore-guiding member, as shown in FIG. 4, the pore-guiding member may be oxidized at the interface between the pore-guiding member and anodized alumina. Therefore, by controlling the thickness of the pore-guiding member, the degree of oxidation may be appropriately controlled; for example, the pore-guiding member is entirely transformed into an oxide, or only the interfaces are oxidized. In particular, in order to transform the pore-guiding member into an oxide, although depending on the material, the thickness of the pore-guiding member is preferably set smaller than the cell size of anodized alumina. Since the cell size of anodized alumina depends on the anodizing voltage, the degree of oxidation of the pore-guiding member can be controlled to a certain extent by the anodizing voltage.

As described above, a layered structure composed of the porous body and the insulator, the metal, or the semiconductor described above, a layered structure composed of the porous body and the metal oxide, or a layered structure composed of the porous body, the electrically conductive material, and the insulating material can be obtained.

With respect to the layered structures shown in FIGS. 2A to 2F, by setting the thickness of the pore-guiding member that separates porous bodies, namely, a distance between porous bodies (shown by D in FIGS. 2B and 2C) at 100 nm or less, preferably at 50 nm or less, and more preferably at 20 nm or less, the positions of narrow pores are correlated between the porous bodies separated by the pore-guiding member, and a tendency to mutually align the positions of narrow pores occurs, which is desirable. By further narrowing the distance between the porous bodies, it is possible to create a state in which the narrow pores in the upper layer and the narrow pores in the lower layer are shifted by a half pitch.

As described above, the short periodic structure of narrow pores (pore distance) can be controlled by the anodizing conditions, and the distance between porous bodies, namely, the porous body period, can be controlled by the thickness of the pore-guiding member (refer to FIGS. 2B, 2C, and 2E). By such structural controls, optical properties of a nanostructure can be controlled. In particular, by laminating a plurality of porous bodies and insulating members, by setting the porous body period at equal distances, or by setting the porous body period at an integral multiple of the pore diameter or the pore distance, significant optical properties are demonstrated, which is desirable. In FIGS. 2B, 2D, and 2E, the pore diameter, the pore distance, and the porous body period are shown.

Figure 5A:
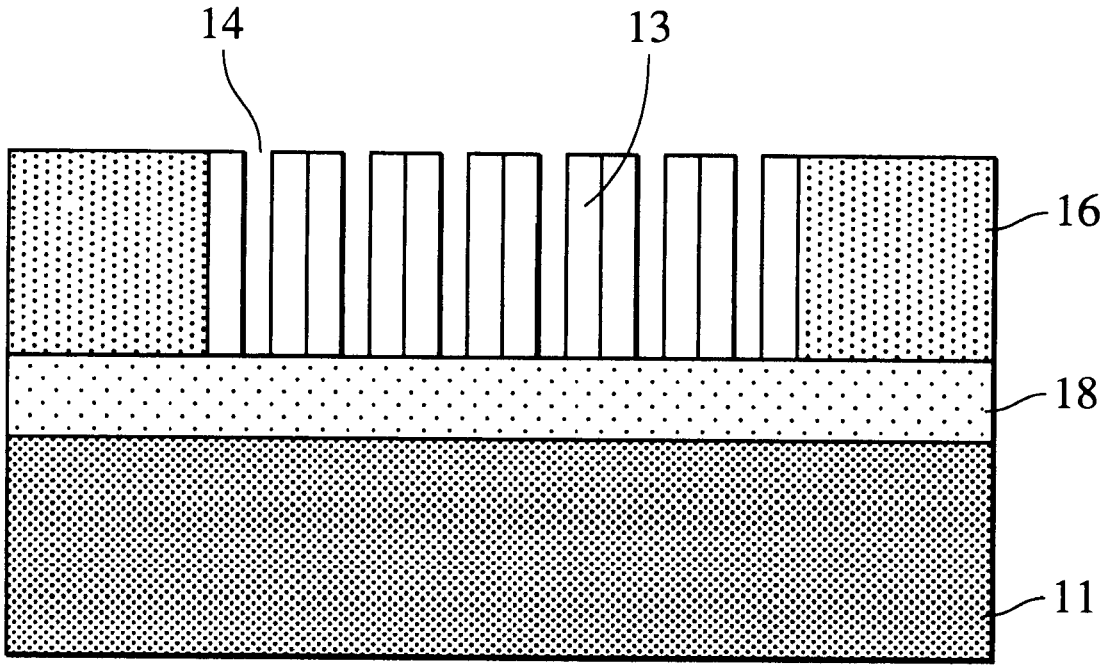
FIGS. 5A and 5B are schematic sectional views which show nano-structures in which pore-terminating members are disposed on the end of narrow pores.
Figure 5B:
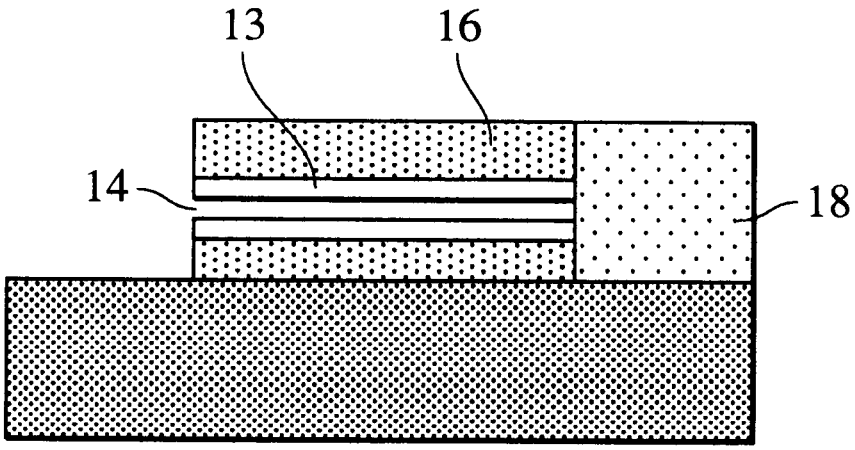

In the present invention, in addition to the structures described above, as shown in FIGS. 5A and 5B, a pore-terminating member 18 may be placed at the section in which the growth of narrow pores is to be terminated. FIG. 5A shows an example of the regional type, and FIG. 5B shows an example of the layered type. In such structures, the lengths (depths) of narrow pores can be set at a predetermined level without control of the anodizing time. The arrival of narrow pores 14 at the pore-terminating member 18 can also be found by the electric current profile during anodization.

Furthermore, in such structures, when a material such as a metal or a semiconductor is filled into the narrow pores, a satisfactory electrical connection between the filler and the pore-terminating member can be obtained.

As the material for the pore-terminating member 18, in view of filling a metal, a semiconductor, or the like into the narrow pores, a conductive material that electrically conducts with the filler and functions as an electrode is preferable.

However, if a noble metal, an element of the iron group, or the like, is used as the pore-terminating member 18, the porous structure is damaged in the anodizing process as follows. As the anodization progresses and a barrier layer 32 (refer to FIG. 10) in the bottom of narrow pores reaches the pore-terminating member 18, the barrier layer 32 is dissolved and the pore-terminating member 18 is brought into contact with an electrolytic solution, and a large anodizing current because of electrolysis of the electrolytic solution (water, acid, or the like) or dissolution of the pore-terminating member 18, results in the damage to the nanostructure.

On the other hand, when a metal such as Ti, Zr, Hf, Nb, Ta, or Mo, or an n-type semiconductor is used as the pore-terminating member 18, a nano-structure can be produced stably, which is desirable. Moreover, by disposing such a terminating material, satisfactory electrical connection between the filler in narrow pores and the pore-terminating member can be obtained.

The pore-terminating member 18 may be partially oxidized at the interface between the pore-terminating member 18 and anodized alumina.

An example of the production method according to the present invention with respect to a structure of the regional type will be described with reference to FIGS. 6A to 6C.

Figure 6A:
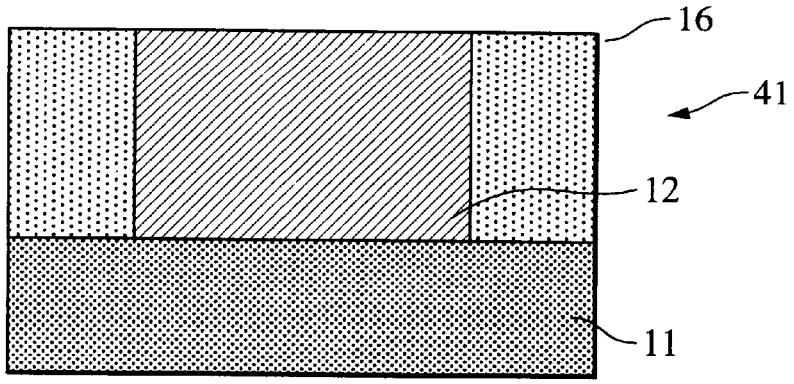
Figure 6B:
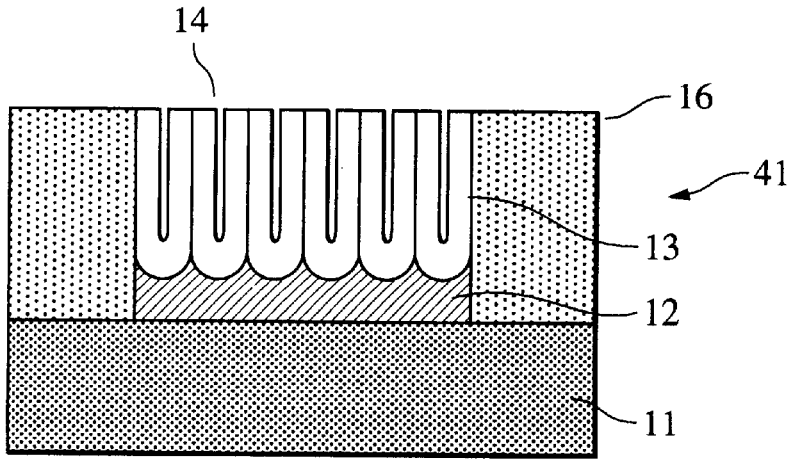
Figure 6C:
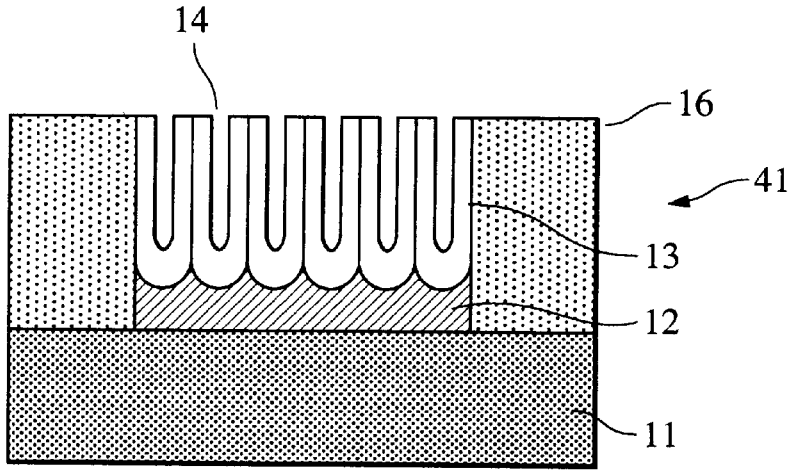

The following steps a) to c) correspond to FIGS. 6A to 6C, respectively.

a) Formation of a Base

On a substrate 11, a film 12 comprising aluminum as a principal ingredient and a pore-guiding member 16 are appropriately formed by patterning so that the pore-guiding member 16 comes into contact with the periphery of the film 12, and thus a base 41 is formed. A pore-terminating member may also be patterned if required.

As the substrate 11, a glass substrate such as silica glass, a silicon substrate, or any other substrate may be used. The deposition of the Al film, the pore-guiding member, and the pore-terminating member may be performed by any deposition method, such as resistance heating evaporation, electron beam (hereinafter referred to as "EB") evaporation, sputtering, CVD, or plating. With respect to patterning of the Al film and the pore-guiding member, a technique such as photolithography or EB lithography may be used.

b) Anodizing Step

By performing anodizing treatment on the base 41, the film 12 comprising aluminum as the principal ingredient is oxidized and narrow pores are formed.

Figure 12:
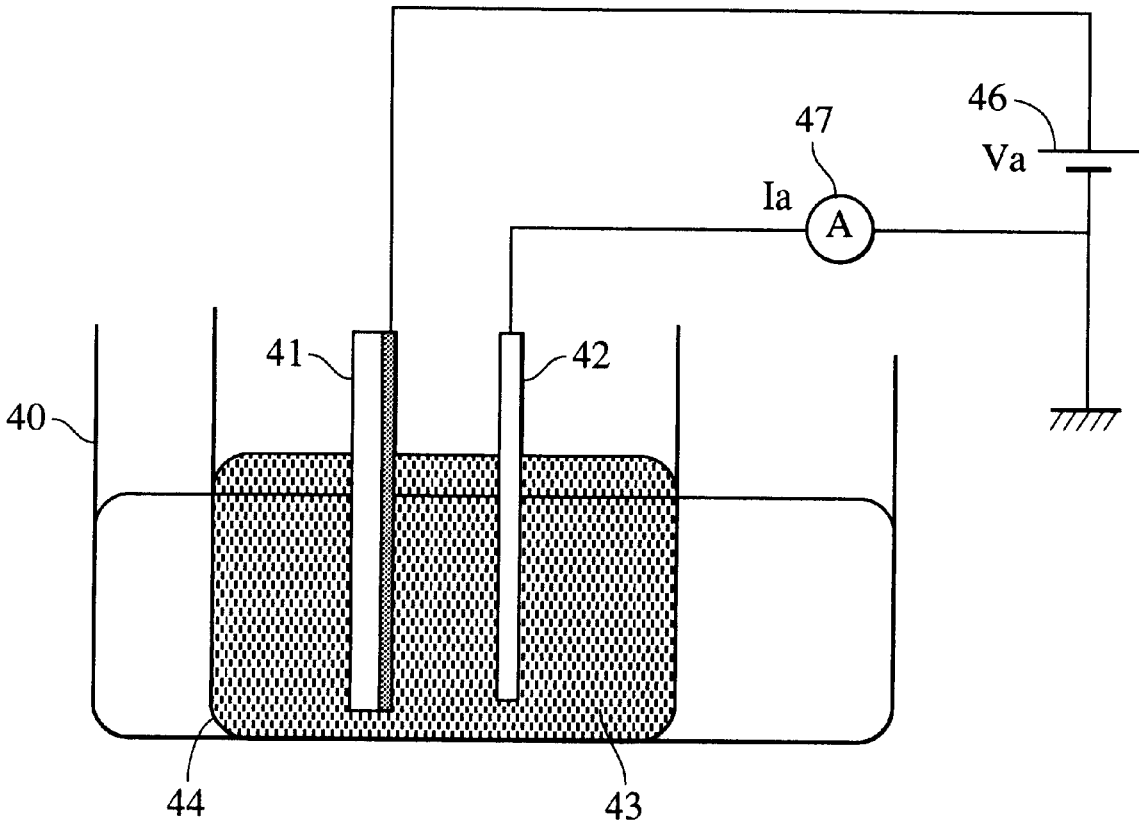
FIG. 12 is a schematic diagram of an anodizing apparatus.

FIG. 12 is a schematic diagram of an anodizing apparatus used in this step.

In FIG. 12, numeral 40 represents a thermostatic bath, numeral 41 represents a base, numeral 43 represents an electrolytic solution, numeral 44 represents a reactor, numeral 42 represents a cathode made of a Pt plate, numeral 46 represents a power supply for applying the anodizing voltage, and numeral 47 represents an ammeter for measuring the anodizing current. Although not shown in the drawing, the apparatus also includes a computer for automatically controlling and measuring the voltage and current, etc.

The base 41 and the cathode 42 are placed in the electrolytic solution 43 in which a constant temperature is maintained by the thermostatic bath 40. Anodizing is performed by applying a voltage between the workpiece and the cathode 42 from the power supply 46.

As the electrolytic solution used for anodizing, for example, a solution of oxalic acid, phosphoric acid, sulfuric acid, or chromic acid may be used. Various conditions such as the anodizing voltage (in the range from 10 to 200 V), anodizing time, and temperature may be appropriately set depending the nano-structures of pore distance, pore depth, etc. to be produced.

c) Pore-widening Treatment

Pore diameters can be widened appropriately by pore-widening treatment in which the base that has been subjected to the anodizing treatment described above is immersed in an acid solution (e.g., a phosphoric acid solution). A structure having desired pore diameters can be obtained depending on the acid concentration, treatment time, and temperature.

The present invention will be described in more detail with reference to the following examples. However, the invention is not limited to the examples.

EXAMPLES 1 to 3 a) Formation of Base

Figure 11A:
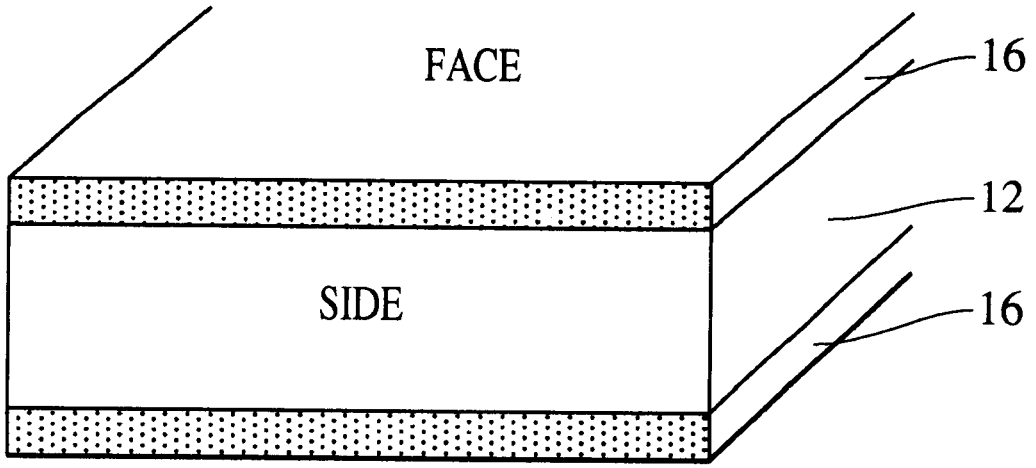

As shown in FIG. 11A, on the upper and lower surfaces of an Al plate 12 (15×40 mm×thickness 1 mm) having a purity of 99.99%, Ti (example 1), Au (example 2), or $SiO_2$ (example 3), as the pore-guiding member 16, was deposited by evaporation at a thickness of 1 $\mu$m to form a base. As comparative example 1, a sample that was not subjected to evaporation was prepared.

b) Anodization

Figure 11B:
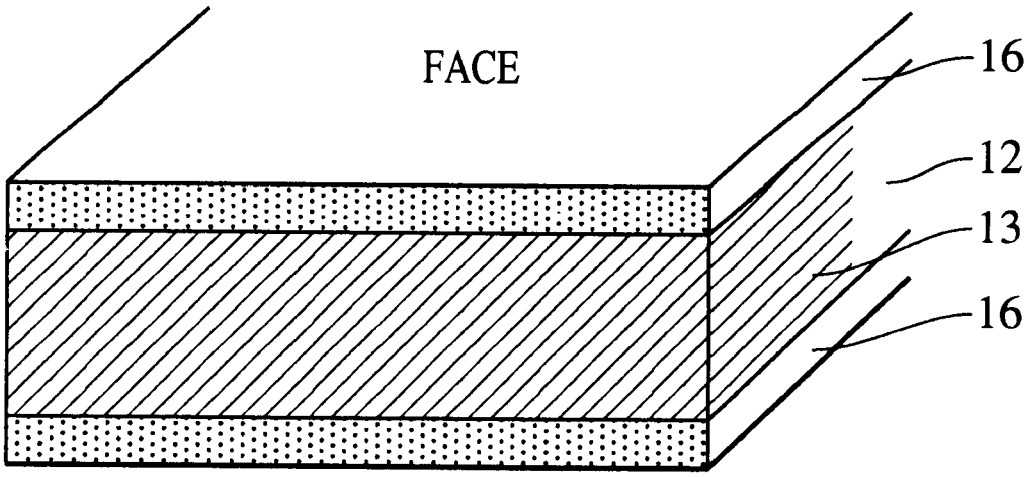

By using the anodizing apparatus shown in FIG. 12, anodization was performed, and thus a porous body 13 was formed as shown in FIG. 11B. In these examples and the comparative example, a 0.3 M oxalic acid solution was used as the acidic electrolytic solution, the solution was maintained at 3° C. with the thermostatic bath 40, and the anodizing voltage was set at 40 V.

In these examples, anodization was performed from the side of the base, namely, the side of the Al plate in the thickness direction, to form narrow pores.

c) Pore-widening Treatment

Diameters of pores (nano-holes) were widened by immersing the samples subjected to anodization in a 5 wt % phosphoric acid solution for 30 minutes.

Evaluation (structural observation):

The sides and cross sections of the retrieved samples were observed by a field emission-scanning electron microscope (FE-SEM).

Results:

In example 2, since a large electric current flowed at the Au section as water was decomposed during anodization, an insufficient voltage was applied to the aluminum, and it was not possible to perform anodization with good reproducibility.

In comparative example 1, in the center of the aluminum plate 12, narrow pores were formed perpendicular to the plate surface (side surface of the body). At the ends of the plate, as shown in FIG. 9B, the array of narrow pores became disordered and the linearity of narrow pores deteriorated.

In examples 1 and 3, as shown in FIG. 8C, from the center to the ends of the plates, linear narrow pores were formed substantially perpendicular to the side of the aluminum plate. The pore diameter was approximately 50 nm, and the distance between narrow pores was 100 nm. In particular, in example 1, better linearity of narrow pores was observed.

EXAMPLES 4 TO 10

In examples 4 to 10, structures of the regional type were produced on substrates by patterning.

a) Formation of Base

Figure 14A:
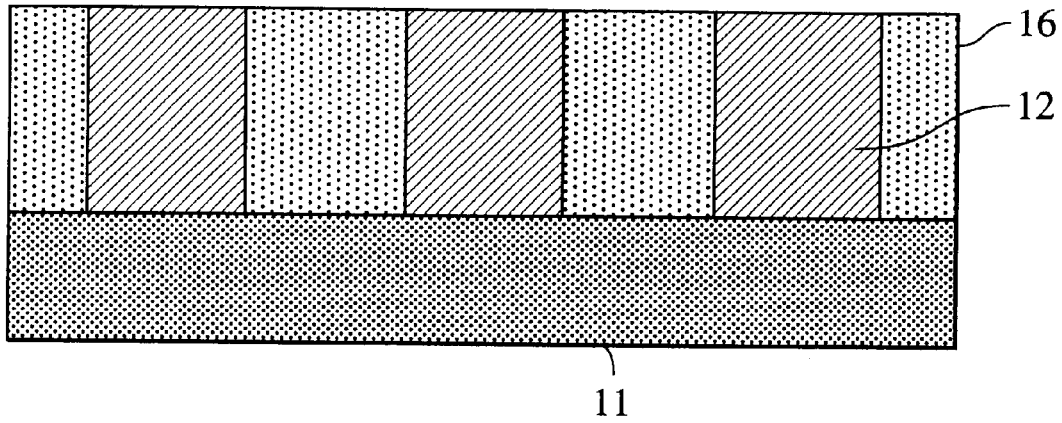
FIGS. 14A to 14C are schematic diagrams which show base structures from example 2, comparative example 2, and comparative example 3, respectively.

Al films 12 and Nb films as pore-guiding members 16 were disposed adjacently on a quartz substrate as shown in FIG. 14A. The individual Al films and Nb films were patterned by photolithography. For example, after an Al film was deposited on the entire surface, a resist was patterned, and Al was partially removed by dry etching. Nb was then deposited, followed by resist stripping and Nb lift-off.

In these examples, the Al film was patterned into lines with a width of 10 microns. The thickness of the Al film was set at 500 nm.

Figure 14B:
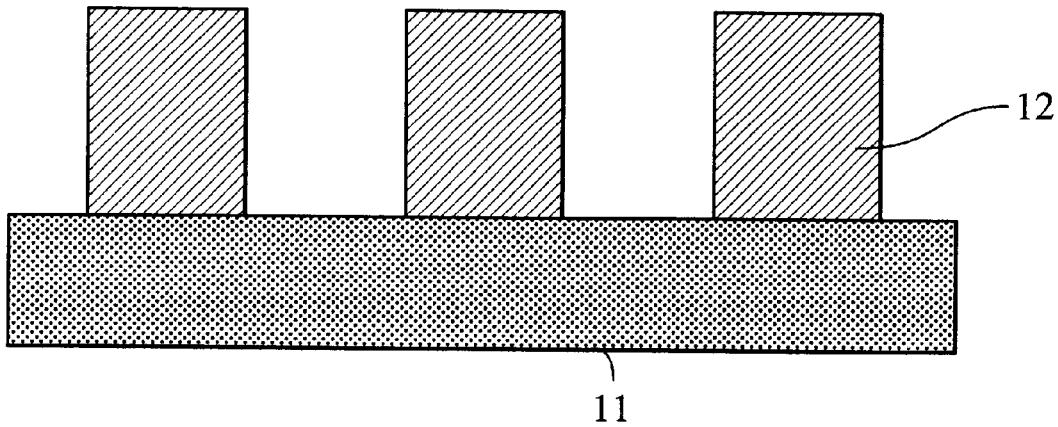

As comparative example 2, as shown in FIG. 14B, in a base, only an Al film was formed into lines with a width of 10 microns, and a pore-guiding member was not disposed.

Figure 14C:
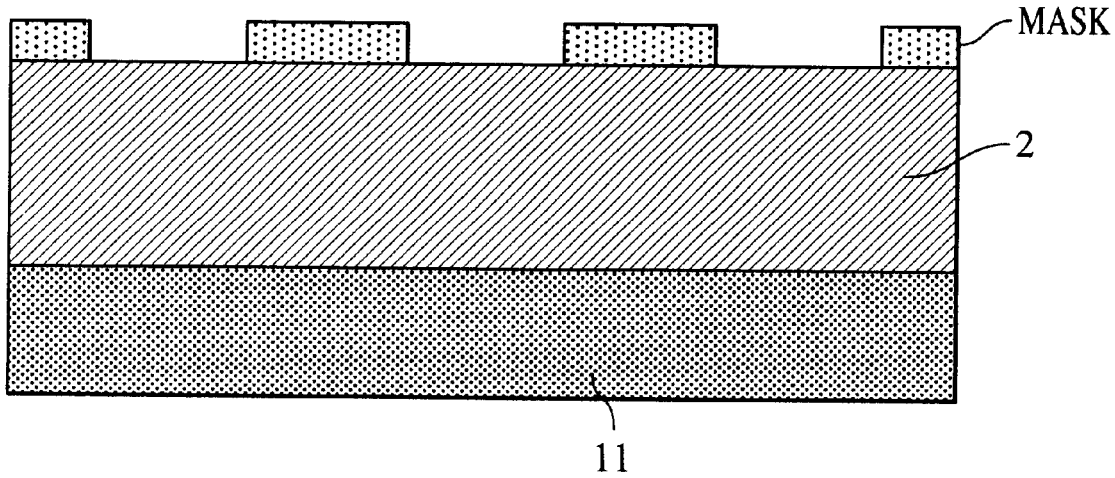

As comparative example 3, as shown in FIG. 14C, an $SiO_2$ mask having a thickness of 100 nm was deposited on an Al film and was patterned into lines with openings having a width of 10 microns.

As example 5, as the pore-guiding member 16, Ni was used instead of Nb.

As examples 6 to 9, as the pore-guiding member 16, Ti, Zr, Ta, and Mo were used, respectively, instead of Nb.

As example 10, as the pore-guiding member 16, $SiO_2$ was used instead of Nb.

b) Anodization

By using the anodizing apparatus shown in FIG. 12, anodization was performed.

In these examples, a 0.3 M oxalic acid solution was used as the acidic electrolytic solution, the solution was maintained at 3° C. with the thermostatic bath 40, and the anodizing voltage was set at 40 V.

c) Pore-widening Treatment

Diameters of nano-holes were widened by immersing the samples subjected to anodization in a 5 wt % phosphoric acid solution for 30 minutes.

Results:

In comparative examples 2 and 3, as shown in FIGS. 8A and 8B, respectively, the narrow pore array became disordered at the ends of the patterns, and the linearity of narrow pores was unsatisfactory.

In example 5, since a large electric current flowed at the Ni section because of the decomposition of water and dissolution during anodization, an insufficient voltage was applied to the aluminum, and a desired nano-structure was not produced.

In example 4, as shown in FIG. 6C, narrow pores were arrayed at equal distances up to the ends of the pattern, and the linearity of narrow pores was satisfactory. The pore diameter was approximately 50 nm, and the distance between narrow pores was 100 nm. Nb was partially oxidized at the interfaces between the sides of porous bodies and Nb.

In examples 6 to 9, in which Ti, Zr, Ta, and Mo were used as pore-guiding members, the same as in example 4, as shown in FIG. 6C, narrow pores were arrayed at equal distances up to the ends of the pattern, and the linearity of the narrow pores was satisfactory.

In example 10, in which $SiO_2$ was used as the pore-guiding member, although narrow pores were formed linearly along the pore-guiding member as shown in FIG. 6C, at the open-ended section of the narrow pores (initially formed section), slight variation in positions and disordered shapes were observed.

EXAMPLES 11 to 26

In examples 11 to 26, nano-structures of the layered type were produced.

a) Formation of Base

Figure 16:
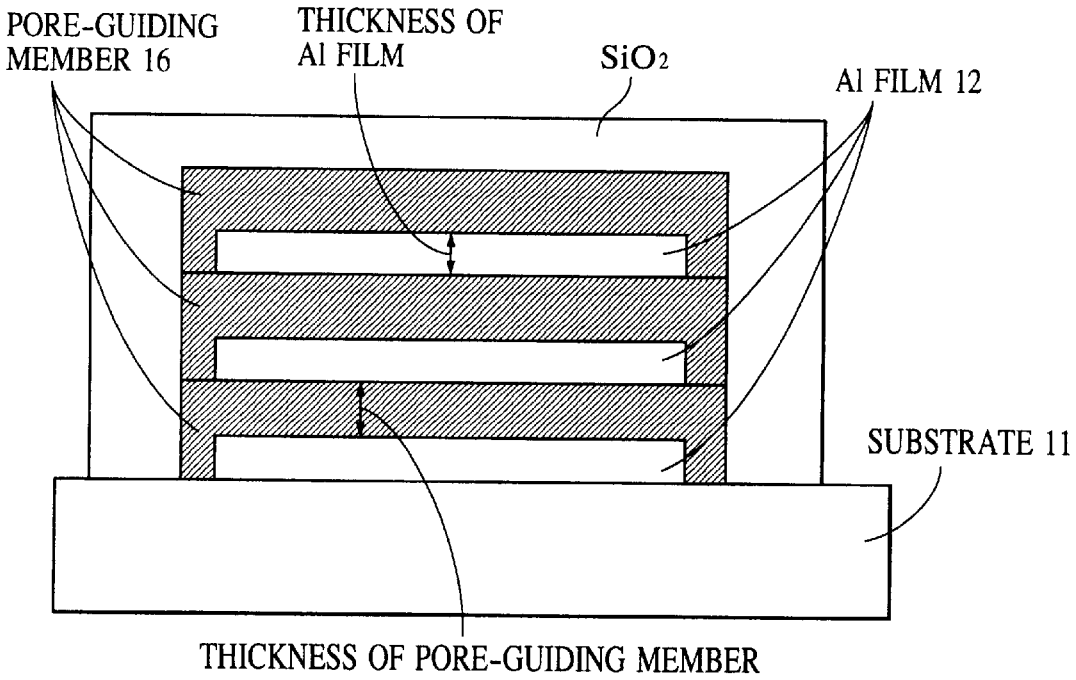
FIG. 16 is a schematic diagram which shows a halfway point in the production process in accordance with the present invention.

In order to form a base in each of these examples, on a silicon substrate, an Al film and a Ti film as a pore-guiding member disposed on the Al film are alternately laminated three times. Furthermore, $SiO_2$ as a protective film was deposited thereon at a thickness of 100 nm (refer to FIG. 16). All the Al films had a thickness of 100 nm. The thicknesses of the Ti films were set at 5 nm (example 11), 20 nm (example 12), 100 nm (example 13), 200 nm (example 14), and 500 nm (example 15). Next, by cutting substrates, cross sections of the laminated layers were formed (refer to FIG. 16).

In examples 16 to 20, instead of Ti in example 13, as pore-guiding members, 100 nm thick Nb (example 16), Hf (example 17), Ta (example 18), Mo (example 19), and W (example 20) were used, and cross sections of the laminated layers were formed in the same manner as that described above.

In example 21, instead of Ti as used in example 13, an $Al_2O_3$ film having a thickness of 100 nm was used as the pore-guiding member.

In examples 22 to 26, instead of Ti that was used in examples 11 to 15, $SiO_2$ was used. The thicknesses of the $SiO_2$ were set at 5 nm (example 22), 20 nm (example 23), 100 nm (example 24), 200 nm (example 25), and 500 nm (example 26).

b) Anodization

By using the anodizing apparatus shown in FIG. 12, bases according to examples 11 to 26 were subjected to anodizing.

In these examples, a 0.3 M oxalic acid solution was used as the acidic electrolytic solution, the solution was maintained at 3° C. with the thermostatic bath 40, and the anodizing voltages of 20 V and 40 V were applied.

c) Pore-widening Treatment

Diameters of nano-holes were widened by immersing the samples in a 5 wt % phosphoric acid solution for 20 minutes.

Figure 17:
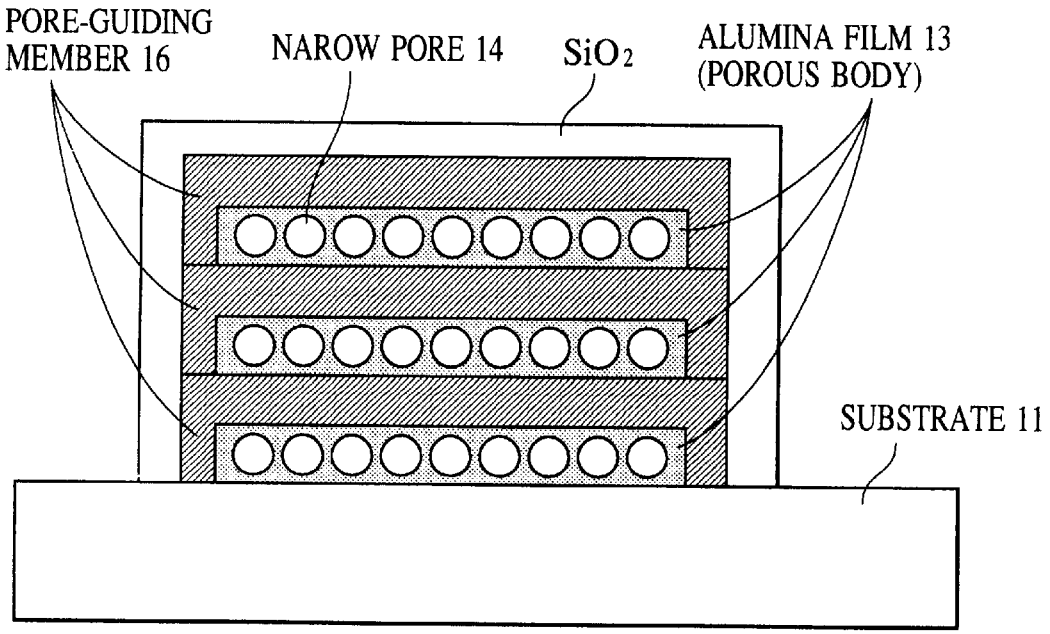
FIG. 17 is a schematic diagram of a structure produced in examples.

Results:

The cross sections of the laminated layers were observed by an FE-SEM and it was found that nano-structures having porous bodies in which narrow pores were arrayed substantially parallel to the planes of lamination and the porous bodies were arrayed substantially parallel to each other had been produced, as shown in FIG. 17 (in the drawing, the number of narrow pores and the array shape are different from those in the nano-structures actually produced).

At the anodizing voltage of 20 V, in the individual porous bodies (anodized alumina), as shown in FIG. 2E, narrow pores having diameters of approximately 30 nm were arrayed substantially in two rows. On the other hand, at the anodizing voltage of 40 V, as shown in FIGS. 2A to 2C, narrow pores having diameters of approximately 30 nm were arrayed in a row.

The distances between the porous bodies (porous body periods) were controlled by the thicknesses of the pore-guiding members. When the anodizing voltage was set at 20 V and 40 V, with respect to the samples in which the thicknesses of the Ti films were 20 nm or less and 100 nm or less, Ti was substantially transformed into titanium oxide, and with respect to the samples in which the thicknesses of the Ti films were larger than the above, as shown in FIG. 4, oxides of Ti were produced at the interfaces with the porous bodies. With respect to the samples in which the pore-guiding members had thicknesses of 100 nm or less, the correlation of the positions of narrow pores between separated porous bodies and the tendency of mutually aligning the positions were observed.

The reflectance spectrum of the individual samples was measured. The spectrum changed in response to the thickness of the pore-guiding members and the anodizing voltage. With respect to examples 22 to 26 in which $SiO_2$ was used as the pore-guiding members, the significant structure in the spectrum was observed in the samples in which the porous body period was set at an integral multiple of the pore diameter or the pore period.

Thus, the possibility of using the nano-structures in accordance with these examples as optical materials was demonstrated.

With respect to examples 16 to 20 in which Nb, Zr, Hf, Ta, Mo, and W were used as the pore-guiding members, nano-structures were produced similarly. In particular, more satisfactory arrays of narrow pores were obtained with respect to Ti, Nb, and Mo.

In example 21 in which $Al_2O_3$ was used as the pore-guiding member, at the section of initial formation of narrow pores, the shape of a large portion of narrow pores became disordered. However, narrow pores were formed substantially parallel to the pore-guiding member.

With respect to examples 22 to 26 in which $SiO_2$ was used as the pore-guiding members, although narrow pores were formed linearly along the pore-guiding member, slight variation in positions and disordered shapes were observed in the open-ended section of the narrow pores (initially formed section).

EXAMPLES 27 to 29

In examples 27 to 29, structures of the needle type were produced.

a) Formation of a Base

In example 27, an Al film having a thickness of 60 nm was deposited around a Mo wire (50 microns thick), and a Ti film having a thickness of 100 nm was further deposited thereon. The sample was then enclosed in a glass tube using an epoxy resin, and the cross section was ground to obtain a base.

In example 28, 10 aluminum wires having a thickness of 25 microns were tied up in a bundle, which was enclosed in a glass tube using an epoxy resin, and the cross section was ground to obtain a base.

In example 29, a Nb film having a thickness of 200 nm was deposited around an Al wire (25 microns thick), which was then covered with a resist. By grinding the resultant rod, a cross section was formed, and thus a base was obtained.

b) Anodization

By using the anodizing apparatus shown in FIG. 12, anodization was performed.

In these examples, a 0.3 M sulfuric acid solution was used as the acidic electrolytic solution, the solution was maintained at 3° C. with the thermostatic bath 40, and the anodizing voltage was set at 25 V.

c) Pore-widening Treatment

Diameters of nano-holes were widened by immersing the samples subjected to anodization in a 5 wt % phosphoric acid solution for 15 minutes.

Results:

In example 27, as shown in FIG. 3C, narrow pores of anodized alumina were arrayed around the Ti rod substantially in a row. The narrow pores were formed extending in the major axis direction of the rod.

In examples 28 and 29, as shown in FIG. 3B, narrow pores were arrayed in the center of the rod, and the narrow pores were formed extending in the major axis direction of the rod. In example 28, the aggregate of narrow pores shown in FIG. 3B were disposed in 10 regions corresponding to 10 aluminum wires.

EXAMPLE 30

In example 30, a pore-terminating member was used and a metal was filled into the narrow pores.

Figure 7A:
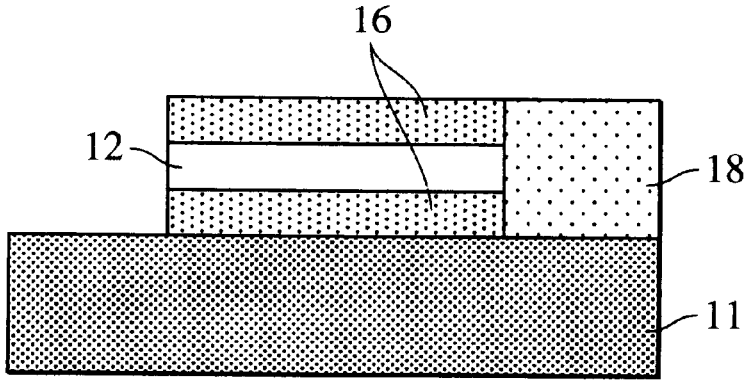

In this example, a base was formed by disposing an Al film 12, pore-guiding members 16, and a pore-terminating member 18 as shown in the sectional view in FIG. 7A. On a silicon substrate 11, a laminated layer including the Al film 12 and the Ti films as the pore-guiding members 16 was formed, and $SiO_2$ (not shown in the drawing) as a protective film with a thickness of 100 nm was further deposited thereon. The thickness of the Al film was set at 100 nm, and the thickness of the Ti film was set at 100 nm. The cross section of the layer was formed by plasma etching. As the pore-terminating member 18, a Ti film having a thickness of 500 nm was used.

Figure 7B:
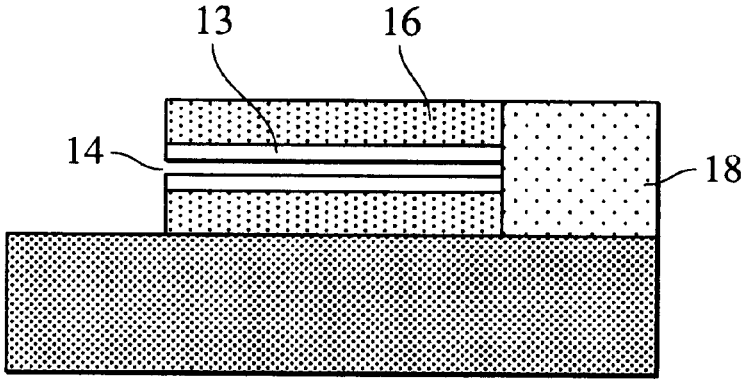

In a manner similar to that in example 10, anodizing and pore-widening treatment were performed (refer to FIG. 7B). During anodization, it was confirmed by a decrease in electric current that anodization reached the pore-terminating member 18.

Figure 7C:
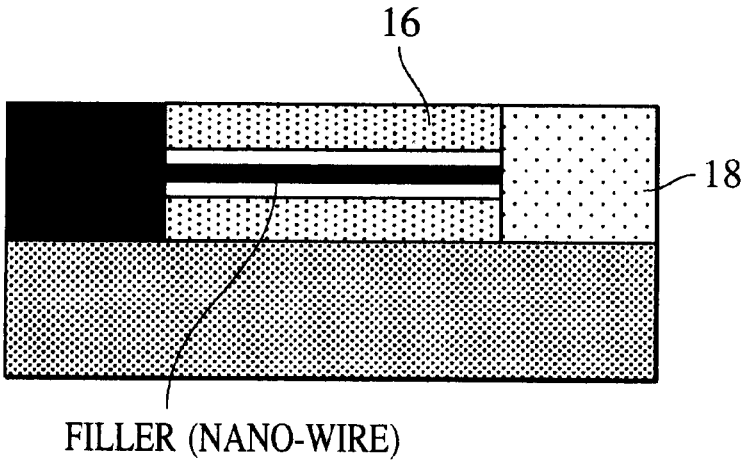

Furthermore, Ni was filled into the narrow pores by electro-deposition (refer to FIG. 7C).

In order to fill Ni, the base provided with the narrow pores, together with a nickel counter electrode, was immersed in an electrolytic solution composed of 0.14 M $NiSO_4$ and 0.5 M $H_3BO_3$. Ni was thus deposited into the narrow pores.

By observing the sample with an FE-SEM before filling Ni, it was confirmed that the narrow pores had reached the pore-terminating member. That is, by disposing the pore-terminating member, the lengths of the narrow pores were controlled. By observing the sample with the FE-SEM after filling with Ni, it was confirmed that the narrow pores had been filled with Ni and quantum wires of Ni having thicknesses of approximately 40 nm had been formed.

EXAMPLE 31

In example 31, using an n-type semiconductor as the pore-guiding member, a nano-structure of the laminated type was produced, the same as example 13. In this example, an Al film was formed in one layer, and two surfaces thereof were covered with a substrate and a Nb film, respectively.

a) Formation of Base

In this example, an Al film was formed on an n-type silicon substrate having a resistivity of 1 Ωcm, and a Nb film was formed thereon to form a base. The Al film had a thickness of 100 nm, and the Nb film had a thickness of 100 nm. Next, by cutting the substrate, a cross section of the laminated layer was formed.

b) Anodization

By using the anodizing apparatus shown in FIG. 12, the sample was subjected to anodizing. In this example, a 0.3 M oxalic acid solution was used as the acidic electrolytic solution, the solution was maintained at 3° C. with the thermostatic bath 40, and the anodizing voltage was set at 40 V.

c) Pore-widening Treatment

Diameters of nano-holes were widened by immersing the sample subjected to anodization in a 5 wt % phosphoric acid solution for 20 minutes.

Results:

As a result of observing the cross section with an FE-SEM, it was confirmed that a nano-structure having a plurality of narrow pores arrayed in a row parallel to the interface between the surface of the silicon substrate and the Al film had been produced.

EXAMPLE 32

In example 32, a nano-structure having nonlinear narrow pores was produced

In this example an Al film was patterned into a fan shape, and an $Al_2O_3$ film as the pore-guiding member 16 was disposed to cover the Al film to form a base. The Al film had a thickness of 100 nm, and the $Al_2O_3$ film had a thickness of 500 nm. The anodization and pore-widening treatment were performed under the same conditions as those in example 11. The resultant nano-structure had a porous body in which nonlinear narrow pores 14 were arrayed in a row, corresponding to the fan shape of the original Al, namely, in a fan shape along the contact surface with the $Al_2O_3$ film, as shown in FIG. 13A.

EXAMPLES 33 and 34

In examples 33 and 34, as shown in FIG. 13C, nano-structures in which bent narrow pores 14 and pore-terminating members 18 were disposed were formed, and a metal was filled into the narrow pores.

Figure 15A:
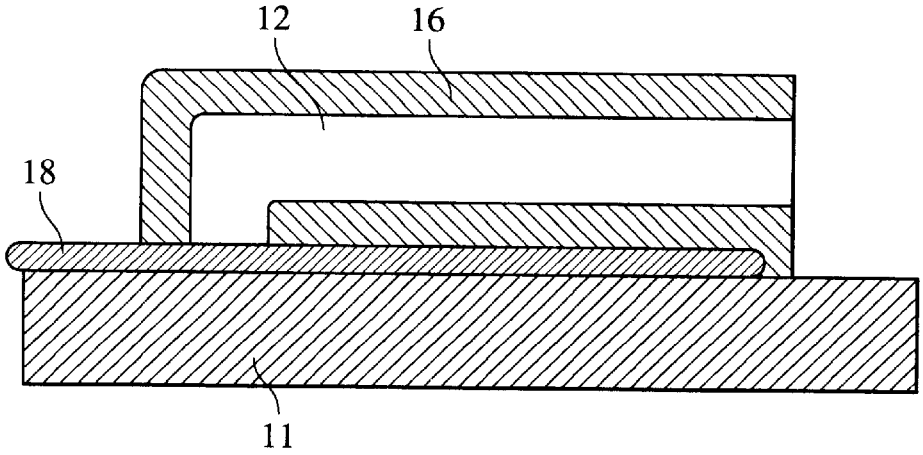

In these examples, a base was formed by disposing an Al film 12, a pore-guiding member 16, and a pore-terminating member 18, as shown in the sectional view in FIG. 15A. As the pore-terminating member 18, a Nb film having a thickness of 100 nm was used, and as the pore-guiding member 16, a $SiO_2$ film having a thickness of 500 nm (example 33) or a Nb film (example 34) was used. The thickness of the Al film 12 was set at 100 nm in each example.

The Al film 12 had a bent section as shown in the sectional view in FIG. 15A.

Figure 15B:
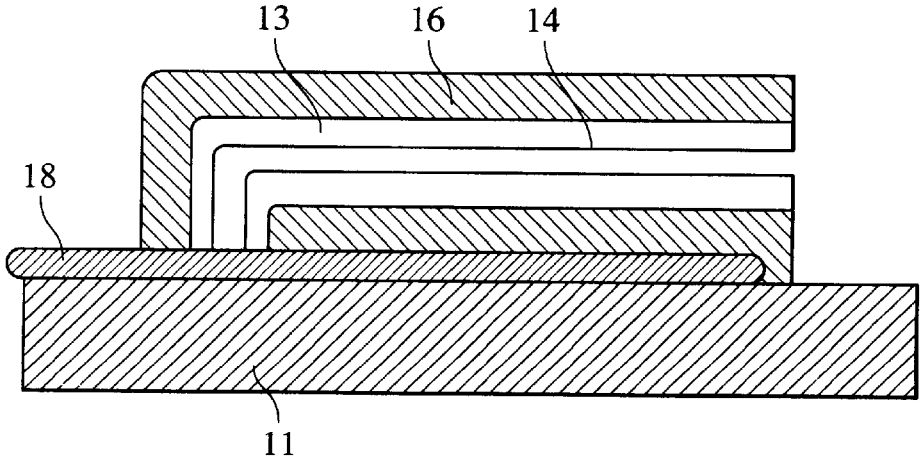

The anodization and pore-widening treatment were performed under the same conditions as those in example 11 (refer to FIG. 15B). During anodization, a decrease in the electric current confirmed that the anodization reached the pore-terminating member.

Figure 15C:
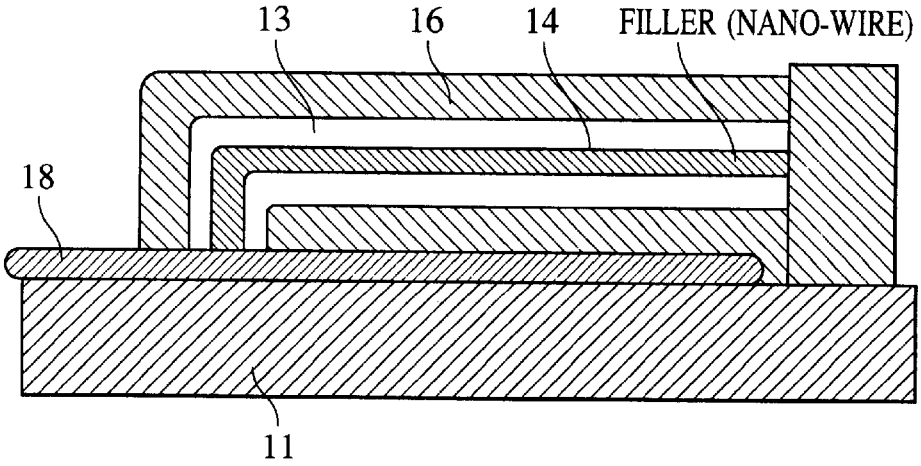

Furthermore, Ni was filled into the narrow pores 14 by electro-deposition (refer to FIG. 15C). In order to fill Ni, the base provided with the narrow pores, together with a nickel counter electrode, was immersed in an electrolytic solution composed of 0.14 M $NiSO_4$ and 0.5 M $H_3BO_3$. Ni was thus deposited into the narrow pores.

By observing the samples with an FE-SEM before filling with Ni, it was confirmed that the narrow pores 14 had reached the pore-terminating members 18. It was also confirmed that narrow pores were formed substantially parallel to the interfaces between the pore-guiding members and the Al films. In example 33, in which $SiO_2$ was used as the pore-guiding member, in comparison with example 34, slight variation in positions and disordered shapes were observed in the section of initial formation of the narrow pores (in which the narrow-pore formation started).

In accordance with these examples, by using the pore-terminating member 18, the lengths of the narrow pores 14 were controlled. It was also possible to bend the narrow pores 14 according to the shape of the pore-guiding member 16.

By the FE-SEM observation after filling with Ni, it was confirmed that the narrow pores were filled with Ni and quantum wires composed of Ni having a thickness of 40 nm or less had been formed.

As described above, the present invention has the following advantages.

1) A porous body (anodized alumina) having narrow pores with excellent linearity can be produced over the entire patterned region.

2) The arrays, distances, positions, directions, etc. of narrow pores formed by anodizing can be controlled appropriately.

3) Novel nano-structures having laminated layers composed of porous bodies and metals or porous bodies and metal oxides can be produced.

4) By defining the terminal of narrow pores, the lengths (depths) of the narrow pores can be controlled.

The above features enable the application of anodized alumina porous bodies to various fields, and the present invention contributes to the significant expansion of the area of application thereof.

Although the structures in accordance with the present invention in themselves can be used as functional materials, the structures may also be used as base materials, molds, or the like for novel structures.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of producing a structure having narrow pores comprising:

a first step of bringing pore-guiding members into contact with upper and lower surfaces of a member comprising aluminum as a principal ingredient; and a second step of anodizing the member comprising aluminum as the principal ingredient to form narrow pores, wherein the pore-guiding members comprise the same material as a principal ingredient.

2. A method of producing a structure having narrow pores according to claim 1, wherein the second step comprises a step of transforming the member comprising aluminum as the principal ingredient into a porous body comprising alumina having narrow pores oriented substantially parallel to the interfaces between the pore-guiding members and the member comprising aluminum as the principal ingredient.

3. A method of producing a structure having narrow pores according to claim 1, wherein the first step comprises a step of alternately laminating pore-guiding members and the members comprising aluminum as the principal ingredient a plurality of times.

4. A method of producing a structure having narrow pores according to claim 1, wherein the pore-guiding members comprise an insulator.

5. A method of producing a structure having narrow pores according to claim 4, wherein the insulator is at least one material selected from the group consisting of $SiO_2$, $Al_2O_3$, SiN, AlN, an epoxy, and a polyimide.

6. A method of producing a structure having narrow pores according to claim 1, wherein the pore-guiding members comprise a metal.

7. A method of producing a structure having narrow pores according to claim 6, wherein the metal is at least one metal selected from the group consisting of Ti, Zr, Hf, Nb, Ta, Mo, and W.

8. A method of producing a structure having narrow pores according to claim 1, wherein the pore-guiding members comprise a semiconductor.

9. A method of producing a structure having narrow pores according to claim 8, wherein the semiconductor is an n-type semiconductor.

10. A method of producing a structure having narrow pores according to claim 9, wherein the semiconductor is n-Si or n-GaAs.

11. A method of producing a structure having narrow pores according to claim 1, wherein the pore-guiding members have thicknesses of 100 nm or less.

12. A method of producing a structure having narrow pores according to claim 11, wherein the pore-guiding members have thicknesses of 50 nm or less.

13. A method of producing a structure having narrow pores according to claim 11, wherein the pore-guiding members have thicknesses of 20 nm or less.

14. A method of producing a structure having narrow pores according to claim 1, wherein the first step further comprises a step of bringing a pore-terminating member comprising metals or semiconductors into contact with the side of the members comprising aluminum as the principal ingredient.

15. A method of producing a structure having narrow pores according to claim 14, wherein the pore-terminating member comprises at least one material selected from the group consisting of Ti, Zr, Hf, Nb, Ta, Mo, and n-type semiconductors.

16. The method of producing a structure having narrow pores according to claim 1, wherein the member comprising aluminum is formed on a substrate and the narrow pores are oriented substantially parallel to the substrate.

17. A method of producing a structure having narrow pores comprising:

a first step of disposing a pore-guiding member and a member comprising aluminum as a principal ingredient having a predetermined pattern on a substrate, the pore-guiding member being in contact with an entire periphery of the pattern of the member comprising aluminum as the principal ingredient; and a second step of anodizing the member comprising aluminum as the principal ingredient to form narrow pores, wherein the pore-guiding member comprises a metal.

18. A method of producing a structure having narrow pores according to claim 17, wherein the second step comprises a step of transforming the member comprising aluminum as the principal ingredient into a porous body comprising alumina having narrow pores oriented substantially parallel to the interface between the pore-guiding member and the member comprising aluminum as the principal ingredient.

19. A method of producing a structure having narrow pores according to claim 17, wherein the narrow pores are formed substantially perpendicular to the surface of the substrate.

20. A method of producing a structure having narrow pores according to claim 17, wherein the first step further comprises a step of disposing between the substrate and the member comprising aluminum as the principal ingredient a pore-terminating member selected from the group consisting of metals and semiconductors.

21. A method of producing a structure having narrow pores according to claim 20, wherein the pore-terminating member comprises at least one material selected from the group consisting of Ti, Zr, Hf, Nb, Ta, Mo, and n-type semiconductors.

22. The method of producing a structure having narrow pores according to claim 17, wherein a surface of the member comprising aluminum as the principal ingredient comprises the narrow pores and is not in contact with the pore-guiding member.

23. A method of producing a structure having narrow pores comprising:

a first step of disposing a pore-guiding member and a member comprising aluminum as a principal ingredient having a predetermined pattern on a substrate, the pore-guiding member being in contact with a periphery of the pattern of the member comprising aluminum as the principal ingredient; and a second step of anodizing the member comprising aluminum as the principal ingredient to form narrow pores, wherein the pore-guiding member is formed after the member comprising aluminum as the principal ingredient is formed, and wherein the pore-guiding member comprises an insulator.

24. The method of producing a structure having narrow pores according to claim 23, wherein the pore-guiding member comprises $SiO_2$.

25. A method of producing a structure having narrow pores comprising:

a first step of disposing a pore-guiding member and a member comprising aluminum as a principal ingredient having a predetermined pattern on a substrate, the pore-guiding member being in contact with a periphery of the pattern of the member comprising aluminum as the principal ingredient; and a second step of anodizing the member comprising aluminum as the principal ingredient to form narrow pores, wherein the pore-guiding member comprises an insulator, said insulator comprising at least one material selected from the group consisting of $Al_2O_3$, SiN, AlN, an epoxy, and a polyimide.

26. A method of producing a structure having narrow pores comprising:

a first step of disposing a pore-guiding member and a member comprising aluminum as a principal ingredient having a predetermined pattern on a substrate, the pore-guiding member being in contact with a periphery of the pattern of the member comprising aluminum as the principal ingredient; and a second step of anodizing the member comprising aluminum as the principal ingredient to form narrow pores, wherein the pore-guiding member comprises at least one metal selected from the group consisting of Ti, Zr, Hf, Nb, Ta, Mo, and W.

27. A method of producing a structure having narrow pores comprising:

a first step of disposing a pore-guiding member and a member comprising aluminum as a principal ingredient having a predetermined pattern on a substrate, the pore-guiding member being in contact with a periphery of the pattern of the member comprising aluminum as the principal ingredient; and a second step of anodizing the member comprising aluminum as the principal ingredient to form narrow pores, wherein the pore-guiding member comprises a semiconductor.

28. A method of producing a structure having narrow pores according to claim 27, wherein the semiconductor is an n-type semiconductor.

29. A method of producing a structure having narrow pores according to claim 28, wherein the semiconductor is n-Si or n-GaAs.

30. A method of producing a structure having narrow pores comprising:

a first step of covering a periphery of a rod-like member comprising aluminum as a principal ingredient with a pore-guiding member; and a second step of anodizing the member comprising aluminum as the principal ingredient to form narrow pores.

31. A method of producing a structure having narrow pores comprising:

a first step of covering a periphery of a rod-like first pore-guiding member with a member comprising aluminum as a principal ingredient and further covering the member comprising aluminum as the principal ingredient with a second pore-guiding member; and a second step of anodizing the member comprising aluminum as the principal ingredient to form narrow pores.

32. A method of producing a structure having narrow pores according to claim 30 or 31, wherein the second step comprises a step of transforming the member comprising aluminum as the principal ingredient into a porous body comprising alumina having narrow pores substantially parallel to the interface between the pore-guiding member and the member comprising aluminum as the principal ingredient.

33. A method of producing a structure having narrow pores according to claim 30 or 31, wherein the pore-guiding member comprises an insulator..

34. A method of producing a structure having narrow pores according to claim 33, wherein the insulator is at least one material selected from the group consisting of $SiO_2$, $Al_2O_3$, SiN, AlN, an epoxy, and a polyimide.

35. A method of producing a structure having narrow pores according to claim 30 or 31, wherein the pore-guiding member comprises a metal.

36. A method of producing a structure having narrow pores according to claim 35, wherein the metal is at least one metal selected from the group consisting of Ti, Zr, Hf, Nb, Ta, Mo, and W.

37. A method of producing a structure having narrow pores according to claim 30 or 31, wherein the pore-guiding member comprises a semiconductor.

38. A method of producing a structure having narrow pores according to claim 37, wherein the semiconductor is an n-type semiconductor.

39. A method of producing a structure having narrow pores according to claim 38, wherein the semiconductor is n-Si or n-GaAs.

40. A method of producing a structure having narrow pores comprising:

a first step of bringing a first pore-guiding member and a second pore-guiding member into contact with upper and lower surfaces of a member comprising aluminum as a principal ingredient; and a second step of anodizing the member comprising aluminum as the principal ingredient to form narrow pores, wherein at least one of the first pore-guiding member and the second pore-guiding member is electrically conductive.

41. A method of producing a structure having narrow pores according to claim 40, wherein the second step comprises a step of transforming the member comprising aluminum as the principal ingredient into a porous body comprising alumina having narrow pores substantially parallel to the interface between the electrically conductive pore-guiding member and the member comprising aluminum as the principal ingredient.

42. A method of producing a structure having narrow pores according to claim 40, wherein the electrically conductive pore-guiding member comprises a metal.

43. A method of producing a structure having narrow pores according to claim 42, wherein the metal is at least one metal selected from the group consisting of Ti, Zr, Hf, Nb, Ta, Mo, and W.

44. A method of producing a structure having narrow pores according to claim 40, wherein the electrically conductive pore-guiding member comprises a semiconductor.

45. A method of producing a structure having narrow pores according to claim 44, wherein the semiconductor is an n-type semiconductor.

46. A method of producing a structure having narrow pores according to claim 45, wherein the semiconductor is n-Si or n-GaAs.

47. The method of producing a structure having narrow pores according to claim 40, wherein the member comprising aluminum is formed on a substrate and the narrow pores are oriented substantially parallel to the substrate.

48. A method of producing a structure having narrow pores comprising:

a first step of alternately laminating pore-guiding members and members comprising aluminum as a principal ingredient a plurality of times on a substrate; and a second step of anodizing the members comprising aluminum as the principal ingredient to form narrow pores.

49. A method of producing a structure having narrow pores according to claim 48, wherein the second step comprises a step of transforming the members comprising aluminum as the principal ingredient into porous bodies comprising alumina having narrow pores oriented substantially parallel to the interfaces between the pore-guiding members and the members comprising aluminum as the principal ingredient.

50. The method of producing a structure having narrow pores according to any one of claims 1, 17, 30, 31, 40 and 48, wherein the narrow pores have diameters from several nanometers to several hundred nanometers.

* * * * *

UNITED STATES PATENT AND TRADEMARK OFFICE

CERTIFICATE OF CORRECTION

PATENT NO. : 6,464,853 B1
DATED : October 15, 2002
INVENTOR(S) : Tatsuya Iwasaki et al.

It is certified that error appears in the above-identified patent and that said Letters Patent is hereby corrected as shown below:

Title page,
Item [30], Foreign Application Priority Data, "11-001239" should read -- 11-001269 --.

Drawings,
Sheet 18, FIG. 17, "NAROW" should read -- NARROW --.

Column 11,
Line 49, "depending" should read -- depending on --.

Column 16,
Line 64, "produced" should read -- produced. --.

Signed and Sealed this

Nineteenth Day of August, 2003

JAMES E. ROGAN
*Director of the United States Patent and Trademark Office*